US007955228B2

(12) United States Patent
Hamilton

(10) Patent No.: US 7,955,228 B2
(45) Date of Patent: Jun. 7, 2011

(54) BICYCLE TRAINER WITH VARIABLE MAGNETIC RESISTANCE TO PEDALING

(76) Inventor: Brian H. Hamilton, Charlotte, NC (US)

( * ) Notice: Subject to any disclaimer, the term of this patent is extended or adjusted under 35 U.S.C. 154(b) by 12 days.

(21) Appl. No.: 12/270,223

(22) Filed: Nov. 13, 2008

(65) Prior Publication Data

US 2010/0062909 A1 Mar. 11, 2010

Related U.S. Application Data

(63) Continuation-in-part of application No. 12/206,696, filed on Sep. 8, 2008, now Pat. No. 7,766,798.

(51) Int. Cl.
*A63B 69/16* (2006.01)

(52) U.S. Cl. ..... 482/61; 482/63

(58) Field of Classification Search ..... 482/57, 482/60, 61, 62, 63, 148, 903, 110; 601/35, 601/36

See application file for complete search history.

(56) References Cited

U.S. PATENT DOCUMENTS

| | | | | | |
|---|---|---|---|---|---|
| 627,483 | A | | 6/1899 | Comly | |
| 1,661,679 | A | | 3/1928 | Privett | |
| 2,462,018 | A | | 2/1949 | Wood | |
| 2,972,478 | A | | 2/1961 | Vincent | |
| 4,506,676 | A | | 3/1985 | Duska | |
| 4,752,066 | A | * | 6/1988 | Housayama | 482/63 |
| 4,813,062 | A | | 3/1989 | Gilpatrick | |
| 4,955,600 | A | | 9/1990 | Hoffenberg et al. | |
| 4,958,832 | A | | 9/1990 | Kim | |
| 5,031,901 | A | * | 7/1991 | Saarinen | 482/63 |
| 5,193,106 | A | | 3/1993 | DeSena | |
| 5,236,069 | A | * | 8/1993 | Peng | 188/267 |
| RE34,479 | E | * | 12/1993 | Minoura | 482/61 |
| 5,382,208 | A | * | 1/1995 | Hu | 482/63 |
| 5,545,982 | A | * | 8/1996 | Vlakancic | 324/174 |
| 5,656,001 | A | * | 8/1997 | Baatz | 482/61 |
| 5,916,067 | A | * | 6/1999 | Morasse | 482/61 |
| 6,042,517 | A | | 3/2000 | Gunther et al. | |
| 6,116,415 | A | | 9/2000 | Rastelli | |
| 6,450,922 | B1 | * | 9/2002 | Henderson et al. | 482/8 |
| 6,508,745 | B1 | | 1/2003 | Schenk et al. | |
| 6,568,446 | B1 | | 5/2003 | Schulte | |
| 6,712,737 | B1 | | 3/2004 | Nusbaum | |
| 6,857,992 | B1 | | 2/2005 | Kolda et al. | |

(Continued)

OTHER PUBLICATIONS

U.S. Appl. No. 12/725,654, filed Mar. 17, 2010 for Modular Tire with Variable Tread Surfaces.

(Continued)

*Primary Examiner* — Loan Thanh
*Assistant Examiner* — Tam Nguyen
(74) *Attorney, Agent, or Firm* — Summa, Additon & Ashe, P.A.

(57) ABSTRACT

A bicycle trainer provides variable resistance to pedaling and allows for a rider to simulate a real-world bicycle course. The trainer engages both the front tire and the back tire of the bicycle and adjusts each according to the rider's preferences during a training session. The front tire lifts up and down as the bicycle moves forward and backward on the trainer. The back tire is adjusted by incorporating magnets thereon in the form of magnetic elements on a sleeve or a clip that engages the back tire and/or the back tire rim. The magnets on the back tire may also be attached to the spokes. The trainer includes magnets as well, usually of opposite polarity, and adds resistance to pedaling when the magnetic fields of the magnets interact to resist back tire revolution.

16 Claims, 29 Drawing Sheets

U.S. PATENT DOCUMENTS

| | | | | |
|---|---|---|---|---|
| 6,945,916 | B2 | 9/2005 | Schroeder | |
| 6,945,917 | B1 * | 9/2005 | Baatz | 482/63 |
| 6,964,633 | B2 | 11/2005 | Kolda et al. | |
| 7,011,607 | B2 | 3/2006 | Kolda et al. | |
| 7,083,551 | B1 | 8/2006 | Lassanske et al. | |
| 7,226,395 | B2 | 6/2007 | Wu et al. | |
| 7,303,510 | B2 | 12/2007 | Gebhardt | |
| 7,311,640 | B2 * | 12/2007 | Baatz | 482/4 |
| 7,314,434 | B2 * | 1/2008 | Chen | 482/63 |
| D593,625 | S | 6/2009 | Pedrini | |
| 7,766,798 | B2 | 8/2010 | Hamilton | |
| 2002/0055422 | A1 | 5/2002 | Airmet et al. | |
| 2002/0193207 | A1 * | 12/2002 | Wang et al. | 482/63 |
| 2003/0073546 | A1 | 4/2003 | Lassanske et al. | |
| 2004/0053751 | A1 | 3/2004 | Pizolato | |
| 2005/0008992 | A1 | 1/2005 | Westergaard et al. | |
| 2005/0209064 | A1 | 9/2005 | Peterson et al. | |
| 2006/0229163 | A1 | 10/2006 | Waters | |
| 2007/0004565 | A1 | 1/2007 | Gebhardt | |

OTHER PUBLICATIONS

U.S. Appl. No. 12/849,204, filed Aug. 3, 2010 for Bicycle Trainer with Variable Resistance to Pedaling.

* cited by examiner

BICYCLE TRAINER WITH VARIABLE MAGNETIC RESISTANCE TO PEDALING

CROSS-REFERENCE TO RELATED APPLICATIONS

This application is a continuation-in-part and claims the benefit of priority to commonly owned U.S. patent application Ser. No. 12/206,696, entitled Bicycle Trainer with Variable Resistance to Pedaling, filed on Sep. 8, 2008 now U.S. Pat. No. 7,766,798. This prior application is incorporated by reference as if set forth fully herein.

FIELD OF THE INVENTION

The invention relates to the field of bicycle trainers for temporarily attaching a bicycle to a frame and for providing variable resistance to pedaling during a training session. The variable resistance is controlled by using magnetic fields between magnets on the rear bicycle wheel and magnets on the trainer.

BACKGROUND OF THE INVENTION

Bicycle trainers have been used in various forms for many decades. Early versions of stationary bicycles allowed a user to pedal on a stand for exercise. See U.S. Pat. No. 4,958,832 (Kim 1990). Over time, technology has progressed to a point where stationary bicycles are computerized for various training options. The computerized exercise equipment allows a rider to simulate hills by adjusting the position of the bicycle and to vary resistance to pedaling via a control system attached to the gears in place on the equipment. One problem with stationary bicycles is that each user has to adjust the settings for their own preferences. Additionally, the stationary bicycle must come in a one-size-fits-all version, meaning that the user has limited options in features such as seat style and tire size.

Over time, the market increased to a point where individualized trainers have been developed, allowing users to attach their personal bicycle to a portable trainer. For example, one brand that has been successful to date is known as CycleOps® . The CycleOps® incorporates a means of adding resistance to the back tire revolution and thereby varying the resistance to pedaling a temporarily attached bicycle.

U.S. Patent Application Nos. 2004/0053751 (Pizolato 2004) and 2005/0209064 (Peterson 2005) disclose modern style bicycle trainers that attach to the back tire of a standard bicycle. The Pizolato '751 application provides a connection to the rear axle of a bicycle with latitude for side to side movement when the rider faces an increased resistance to pedaling. An electrical control generator provides the resistance to pedaling. The Peterson '064 application provides a rear tire mount but requires removing the front tire to exercise on the bicycle. Springs at the back of the trainer provide a righting force when the user stands to pedal. Peterson discloses fluid-filled cylinders, magnetic assemblies, and airflow devices to control the resistance to pedaling.

Other developments in bicycle trainers include mechanisms for adjusting the front tire of a bicycle during trainer exercises. U.S. Pat. No. 7,083,551 (Lassanske 2006) provides a mechanical apparatus for lifting the front tire of a bicycle connected to a trainer frame at the back tire. The Lassanske patent, however, requires the user to manually place the front tire of the bicycle in one of several select positions at different heights. Generally, the Lassanske device uses a pedestal for raising the front end of the bicycle via several support members.

U.S. Patent Application No. 2007/0004565 (Gebhardt 2007) provides a more extensive combination of trainer options by attaching the rearward driven tire on the bicycle to a trainer frame with a resistance device pressing against the back tire. The front of the trainer lifts the bicycle up and down, and the front and back parts of the trainer are electronically controlled for a more realistic riding experience. In preferred embodiments, the Gebhardt patent application utilizes linear actuator motors electronically controlled by a common signal to determine the height of the front tire lift and the resistance of the resistance device. Gebhardt also connects the front tire lift and rear tire resistance via cabling, bearing assemblies, and mechanical linkage assemblies. Gebhardt adjusts the rear tire position during front tire elevation changes only by an apparently stationary axle clamp.

More modern bicycle trainers also include electronics to control the tire position and resistance to pedaling in a training scenario. U.S. Patent Application No. 2002/0055422 (Airmet 2002) discloses a training apparatus for temporarily attaching a standard bicycle to a trainer controlled by electronic inputs. The trainer simulates an environment where the operator experiences three-dimensional motion and pedaling resistance similar to that of riding a real bicycle. The resistance to pedaling is a variable electromagnetic resistor controlled by input from interactive data received from an associated control system. The rear tire of the bicycle is held in place by axle locking mechanisms that are fixed in place. A rocker assembly allows the bicycle to simulate turns by tilting the bicycle left and right at angles that are in accordance with the rider's position and commands from the control system. The Airmet '422 application, however, provides no way to adjust the front tire elevation or any adjustments to front and back translation of the bicycle.

Other trainers with electronic components connected thereto include U.S. Patent Application No. 2003/0073546 (Lassanske 2003) (showing a generator connected to the rear tire for powering the trainer components); 2005/0008992 (Westergaard 2005); and 2006/0229163 (Waters 2006). Each of these publications includes components necessary for electronically controlling a bicycle's position on a trainer. While these documents show various combinations of front tire and rear tire lifts that a rider can use to maneuver a bicycle in a simulated training circuit, none of these embodiments provides for new ways of controlling the resistance element engaging the back tire. Furthermore, none of these published patent applications provides for any forward and backward translation of the bicycle during times of raising and lowering the front tire.

Varying the resistance to pedaling can also be accomplished by using magnetic devices. U.S. Pat. No. 7,011,607 (Kolda 2006) shows a variable magnetic resistance unit for an exercise device such as a bicycle trainer in which the degree of resistance is automatically and non-linearly adjusted in relation to the rotational speed of a rotating member in contact with the back tire. As a flywheel rotates in response to rotation of the bicycle tire, magnets in the flywheel interact with a conductive portion of the flywheel to establish eddy currents in the conductive portion. The locations of the eddy currents, which change as the tire rotates, increase and decrease resistance to rear tire revolution. In operation, the flux density generated by magnets remains constant, and resistive forces vary by adjusting the radial position of the magnets in relation to the flywheel. Other patents showing bicycle trainers with magnetically induced eddy currents include U.S. Pat. No. 6,042,517 (Gunther 2000) and U.S. Pat. No. 6,945,916 (Schroeder 2005).

U.S. Pat. No. 6,857,992 (Kolda 2005) shows a roller type bicycle trainer with a frame and a series of rollers that support the wheels of a bicycle. Magnets in the body of the trainer create eddy currents in an electrically conductive roller. By positioning the magnets in different places in relation to the rollers, particularly the electrically conductive roller, the rider can control eddy current strength in the trainer and resistance to pedaling. See also U.S. Pat. No. 5,656,001 (Baatz 1997).

Beyond the realm of eddy currents, exercise machines have been produced that use opposite magnetic forces to vary resistance to pedaling. U.S. Pat. No. 6,508,745 (Schenk 2003) discloses a stationary exercise bicycle with magnets on a back tire that rotates at least in part through a magnetic chamber encased within the trainer. The back wheel includes a magnetically attractive strip about its outer circumference. The trainer includes a resistance system with an electromagnetic force applied to the strip for controlled resistance. Obviously, however, the stationary bicycle does not allow a user to exercise with his or her own standard bicycle that can be attached and detached to a portable trainer.

Accordingly, there exists a need in the art of bicycle trainers for an apparatus that allows for simulation of real world bicycle courses in a stationary trainer adapted for use with a standard bicycle. The trainer preferably includes improved mechanisms for applying resistance to the rear bicycle tire via magnetic mechanisms.

BRIEF SUMMARY OF THE INVENTION

The invention is a bicycle trainer that allows the rider to vary resistance to pedaling by placing a magnetic mechanism on the rear wheel of the bicycle and placing the magnetic mechanism within the magnetic field of a different magnetic mechanism. The first magnetic mechanism is part of a bicycle trainer that holds or at least stabilizes the rear wheel of a bicycle. The first magnetic mechanism may be of a shape that surrounds the rear tire of the bicycle, or, in a different embodiment, the first magnetic mechanism may be portable and modular such that the rider adjusts the position, and therefore the magnetic field strength, of the first magnetic mechanism.

The second magnetic mechanism may be attached to the rear wheel of the bicycle by attaching the second magnetic mechanism to a sleeve that fits around the rear tire. Alternatively, the second magnetic mechanism may be attached to the rear tire via spoke attachments carrying the second magnetic mechanism. Overall, the bicycle trainer of this invention varies the magnetic resistance between the first and second magnetic mechanisms by varying the magnitude of the magnetic fields between the two. The relative magnetic fields determine the resistance to rear tire revolution.

DETAILED DESCRIPTION

Figure 1A:
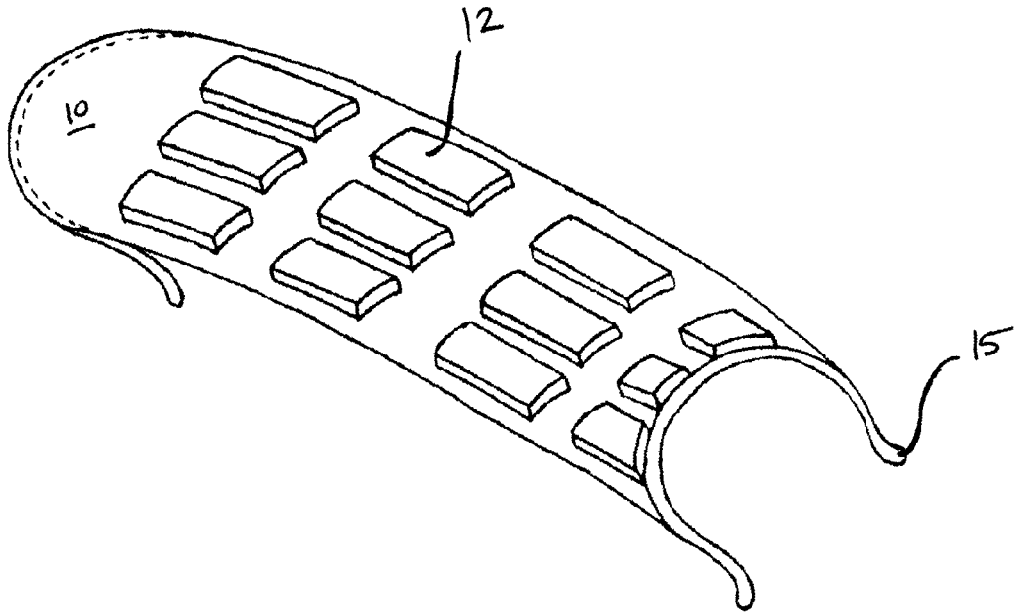
FIG. 1A is a perspective view of a bicycle tire sleeve having magnets disposed over the surface.

The invention encompasses a bicycle trainer that provides variable resistance to pedaling and allows for a rider to simulate a real-world bicycle course, including maneuvering up and down hilly terrain. Overall, the trainer 50 engages both the front tire 16 and the back tire 17 of the bicycle 40 and adjusts each according to the rider's preferences for training. One useful aspect of the disclosed trainer is its ability to accommodate an individual's personal bicycle 40. In other words, the trainer 50 does not include built-in biking equipment but lets a rider use his or her own bicycle 40 in a training situation. This distinguishes the trainer 50 from an exercise bicycle of the prior art.

The invention includes diverse mechanisms for controlling the resistance to pedaling that a user encounters when using the trainer 50. Each embodiment of the trainer includes parts and mechanisms that are interchangeable among each other. In other words, the invention is not limited to specific embodiments of the invention as set forth in the drawings and claims, but each embodiment may utilize features from the other embodiments. Furthermore, each embodiment and combination of the invention described herein incorporates standard electrical circuitry and computerized systems that are known in the art of control systems. This is particularly true in regard to electromagnets. For purposes herein, the magnets illustrated on the drawings and discussed in the text can be either permanent magnets or electromagnets in most situations. The drawings schematically represent the portions of the device that enable full utilization of the invention, but the drawings are not intended to limit the invention to any particular arrangement for standard electrical components (i.e., power circuits, control circuits, cables, and associated connectors).

Figure 2:
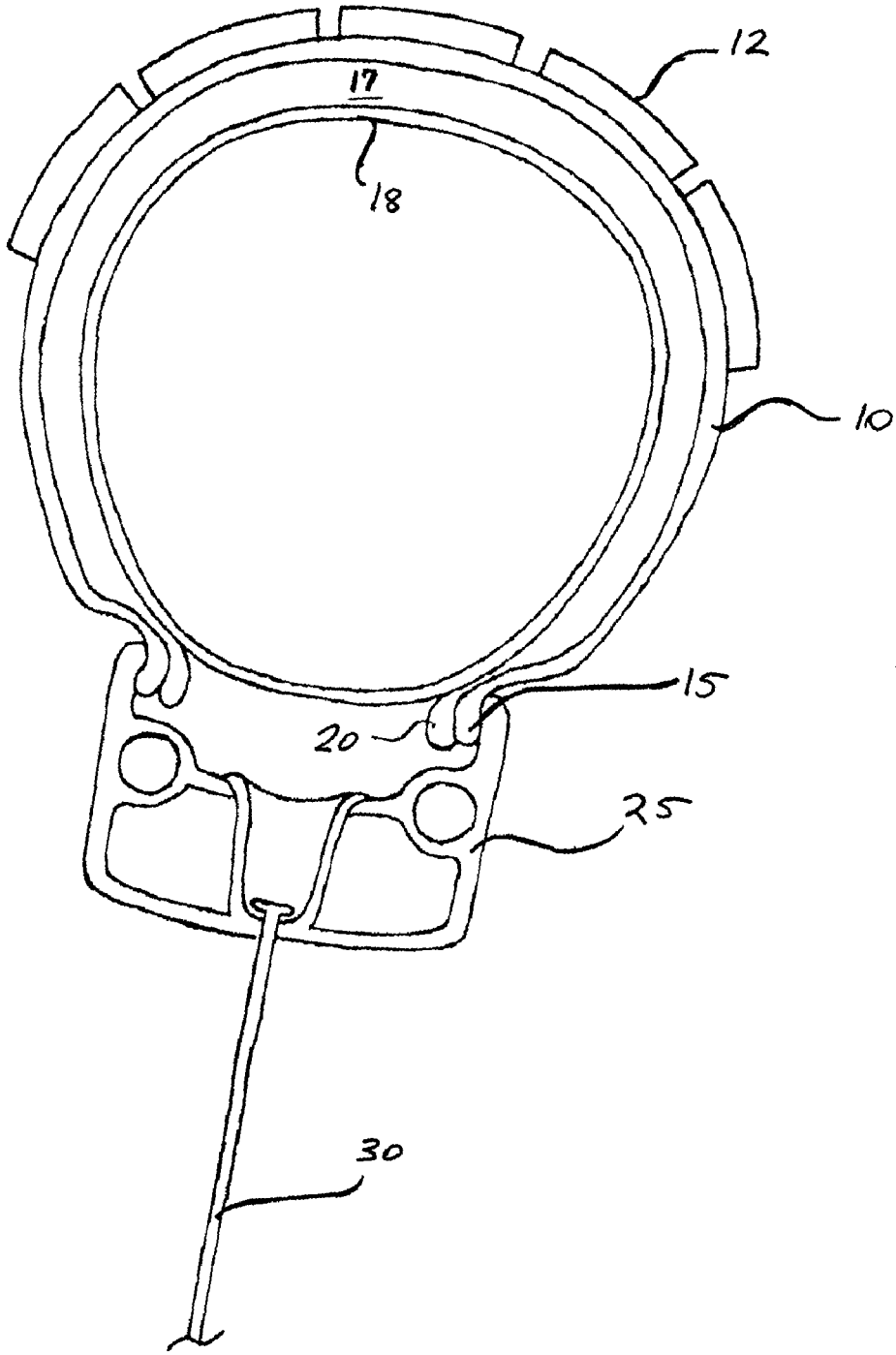
FIG. 2 is a cross sectional view of the rear tire of a bicycle having a removable magnetic sleeve installed thereon.

One of the most versatile embodiments of the bicycle trainer according to this invention utilizes a removable sleeve 10 that fits over the back tire 17 of the attached bicycle 40. The sleeve 10 is generally an elastomeric sheath that is adaptable to fit around the back tire 17 and removably attach to the tire 17. The sleeve 10 may fit over the entire exposed surface of the back tire 17 or over any portion that allows the sleeve to engage the back tire and remain securely attached. In a preferred embodiment, shown in FIG. 2, the sleeve 10 includes a sleeve bead 15 that is adapted to fit within the rim 25 of the bicycle 40 and secure the sleeve 10 over the back tire 17.

In a most preferred embodiment, the back tire 17 of the bicycle may be deflated so that the rim 25 is accessible. The sleeve 10 is fitted entirely over the deflated tire and the underlying inner tube 18 under the back tire 17. The back tire 17 includes a back tire bead 20 that ordinarily engages the tire rim 25. Similarly, the sleeve 10 includes a sleeve bead 15 that engages the tire rim to stay in place. Once the sleeve 10 is placed within the rim 25 and over the back tire 17, the inner tube 18 is re-inflated to proper tire pressure. After re-inflation, the inner tube 18 engages the tire 17 which, in turn, engages the sleeve 10. In preferred embodiments, the sleeve fits snugly over the tire 17 until removed by deflating the inner tube 18 again. Alternatively, a magnetic sleeve may be placed between the inner surface of the tire 17 and the deflated inner tube (not shown). The inner magnetic sleeve may include a bead fitting and/or adhesive construction to stay in place. In either embodiment, the result is that the back tire 17 has a magnetic field emanating from it. This magnetic field is then available for incorporating within the magnetic field emanating from the trainer itself to control resistance to pedaling.

Figure 1B:
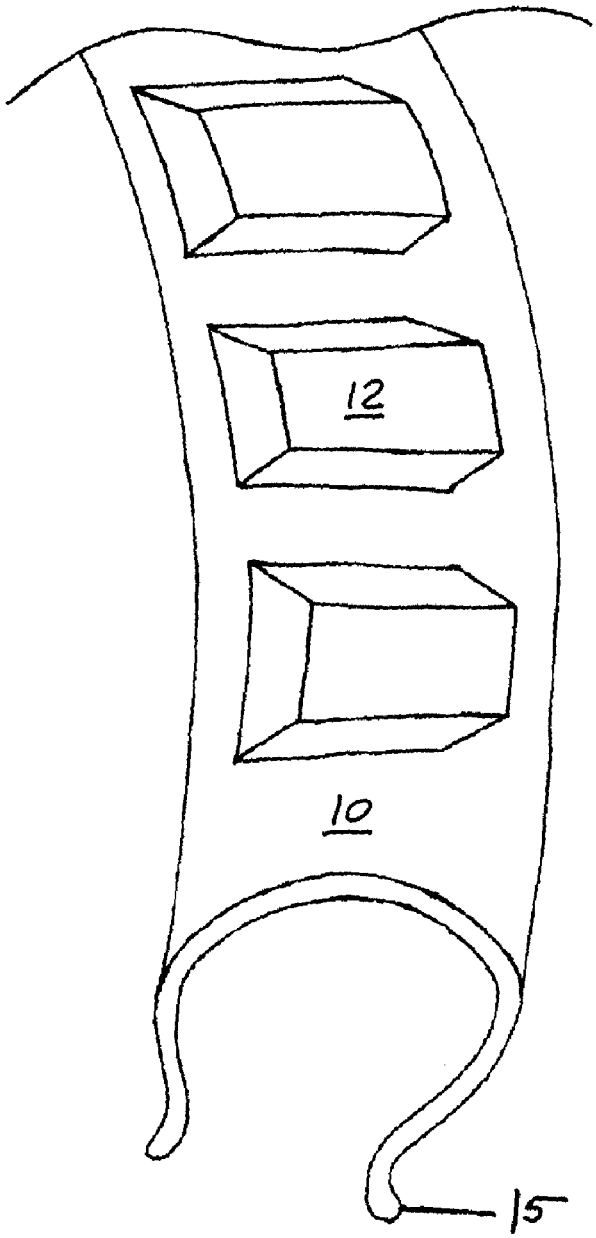
FIG. 1B is a close up view of a sleeve according to this invention having magnets of enlarged cross section disposed about the circumference.

The surface of the sleeve 10 may include magnetic elements 12 that provide a magnetic field with which the bicycle trainer 50 provides resistance to back tire revolution. The magnetic elements 12 may be of any shape or pattern, including solid and/or smooth magnetic elements, and generally of any size to suit the purpose at hand. Without limiting the invention in any way, the magnets may be attached to the sleeve in patterns that are continuous, intermittent, checked, striped, raised, flat, or any desirable configuration. A sleeve 10 with magnetic elements 12 of larger cross section, for example, is shown in FIG. 1B. In preferred embodiments, the magnetic elements 12 are permanent magnets that are fixed to the surface of the sleeve 10, but the magnetic elements may also be electromagnets in certain instances. In other embodiments, the number of magnetic elements may be adjusted by the user. The magnetic elements 12 may be attached to the sleeve 10 by known attachment mechanisms. For embodiments allowing the magnetic elements 12 to be removed, one convenient attachment mechanism is a hook and loop type of fastener, but removable magnetic mechanisms may be attached to the sleeve 10 by buttons, snaps, glue, and the like. The magnetic elements 12 may cover the surface of the sleeve 10 in any number of patterns, designs, or even cover the surface entirely.

Figure 3:
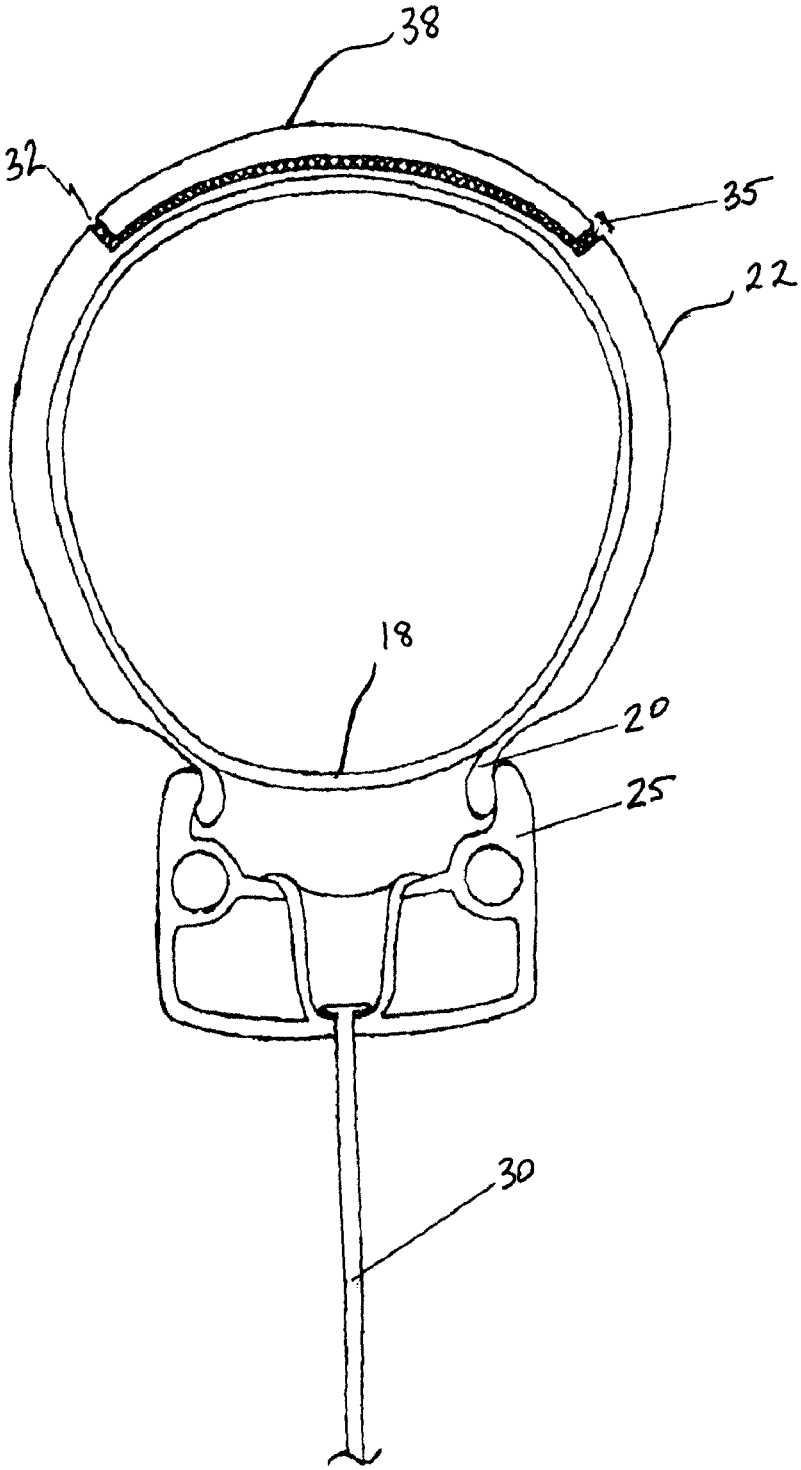
FIG. 3 is a cross sectional view of a rear bicycle tire slotted about its circumference and having a magnetic strip disposed within the slot.

FIG. 3 is another embodiment of the sleeve 10 that provides a magnetic field and an opportunity to magnetically control and vary resistance to back tire revolution. FIG. 3 shows a bicycle tire embodiment by which an inner tube 18 is surrounded by an entirely new kind of tire 17. The tire of FIG. 3 is a slotted tire 22 that includes a slot 35 that can also be described as a channel or a groove. The slot 35 runs around the entire circumference of the slotted tire 22 between the sides of the tire. In the embodiment of FIG. 3, a magnetic strip 38 is attached to the slotted tire 22 within the slot 35. The magnetic strip 38 may be attached by known temporary attachment mechanisms (32), such as hook and loop fasteners. In a preferred embodiment, the magnetic strip 38 is removable and replaceable so that magnetic elements 12 of varying magnetic field strength can be attached thereto. FIG. 3 shows the slotted tire 22 directly adjacent the inner tube 18 (i.e., the slotted tire 22 is the back tire of the bicycle). The embodiment of FIG. 3 encompasses designs to be used in sleeve embodiments similar to that of FIGS. 1 and 2. In a sleeve embodiment, a slotted sleeve fits around a regular tire that is known in the art today. The sleeve 10 would incorporate a slot 35 about its circumference for placement of a magnetic strip 38 around the back tire 17.

Figure 4:
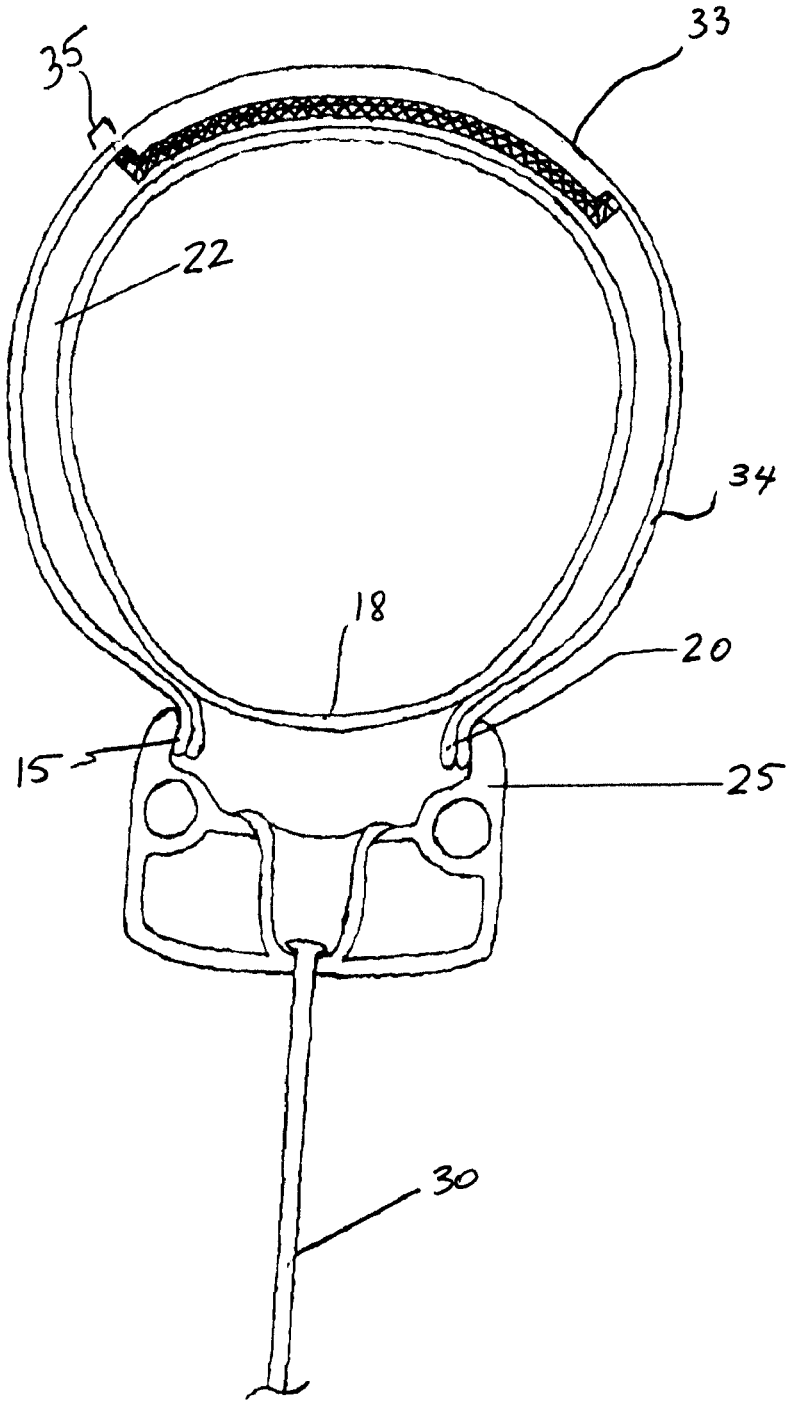
FIG. 4 is a cross sectional view of a rear bicycle tire slotted about its circumference and having a magnetic sleeve disposed therein.

FIG. 4 shows yet another sleeve embodiment using a slot or groove 35 in a slotted back tire 22. In FIG. 4, a slotted tire 22 fits into the bicycle tire rim 25 and attaches to the rim by a slotted tire bead 20. Over the slotted tire 22, a magnetic strip-sleeve 33 also fits within the rim 25 via a bead 15. The magnetic strip-sleeve 33 includes the magnetic strip 38 discussed above that fits into the groove or channel 35 of the slotted tire 22. In this embodiment, however, the magnetic strip 38 is encompassed within the overall sleeve that has extensions (34) that fit down into the rim. The extensions (34)

may be made of rubber or other polymeric material that allows the magnetic strip sleeve to fit snugly over the back.

Figure 5A:
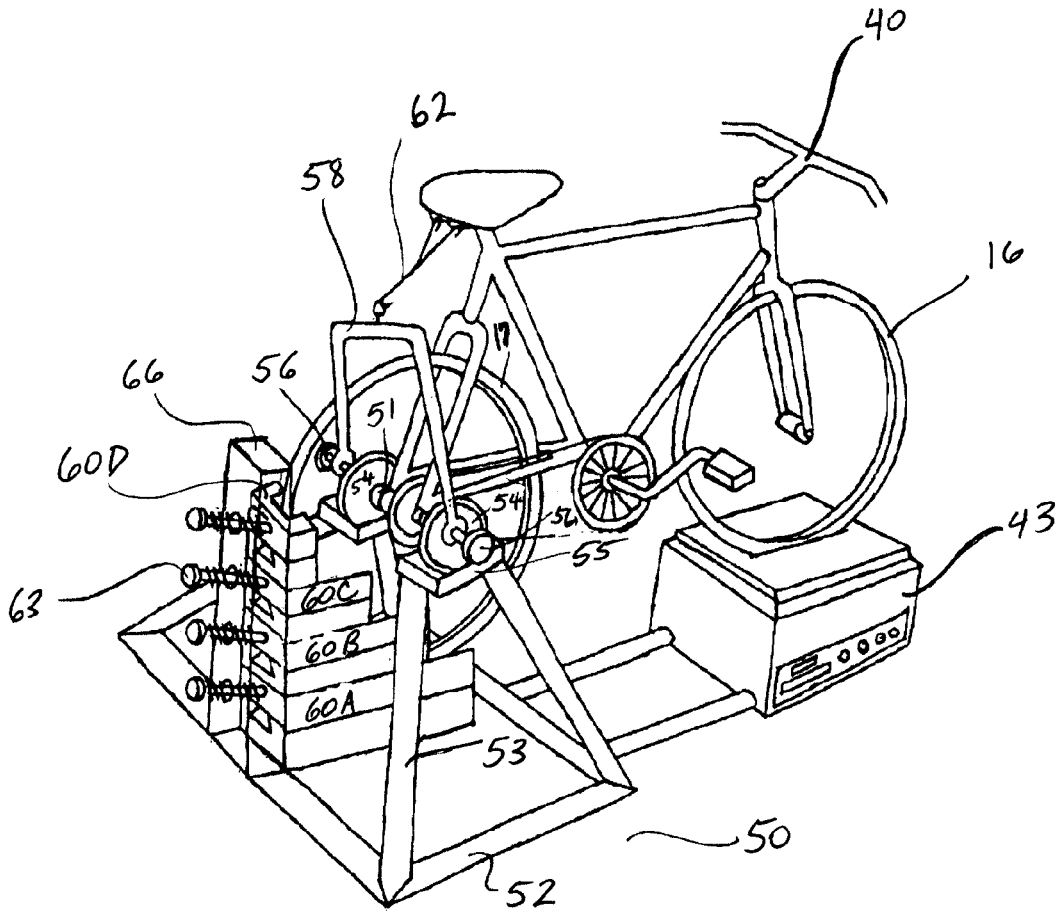
FIG. 5A is a perspective view of a bicycle trainer according to this invention having a modular set of magnets surrounding the rear tire of a bicycle and with magnets installed on the rear tire in accordance with this invention.

Regardless of which type of sleeve 10 fits over the back tire 17, preferred embodiments of this invention provide a magnetic field emanating from the back tire. To accomplish the goal of variable magnetic resistance, the trainer 50 includes another source of magnetism on the trainer 50 itself. FIG. 5A shows the trainer 50 with a bicycle 40 attached. The trainer 50 includes a lifting mechanism 43 attached to the front tire of the bicycle 40. The lifting mechanism is substantially similar to the lifting mechanism described in co-pending U.S. patent application Ser. No. 12/206,696 filed on Sep. 9, 2008, by practice, the lifting mechanism 43 is an electrically powered lift that includes appropriate mechanical operations to move the front end of the bicycle 40 up and down. As discussed in the prior '696 patent application, the lifting mechanism is programmable to move the bicycle front tire up and down according to a known and systematic program. The lifting mechanism 43 may include a means of stabilizing and controlling the position of the front tire 16 via an attachment mechanism (not shown) removably connected to the front tire. The attachment mechanism provides a method of moving the entire bicycle forward and backward as the lifting mechanism 43 moves up and down. In a preferred embodiment, the lifting attachment mechanism encircles a portion of the front tire in an arcuate configuration to allow lift and translation of front tire and bicycle. Although electrical connections are not shown, the trainer 50 may accommodate standard data and power connections for any parts discussed herein, particularly for the lifting mechanism 43 which, in one embodiment, is fitted with a CD-ROM player to track the up and down terrain of a real world bicycle course, moving the bicycle by the lifting mechanism according to programmed electronic control systems.

The trainer 50 is characterized, in part, by its ability to allow for lateral translation of the bicycle. The frame 52 of the trainer engages the rear tire of the bicycle with the frame lifting the rear tire off the ground. In this embodiment, the frame of the trainer attaches to capped rollers that engage the bicycle back tire axle and hold it up. As the lifting mechanism 43 moves the front tire up and down, the back tire 17 moves forward and backward along translation platform 55. To accommodate the lateral (forward and backward) translation, the trainer 50 attaches to the bicycle via rollers 54 that rest on the translation platforms 55. In a different embodiment, the translation platforms 55 include a pivot point that angles the position of the translation platform. By coordinating the angle of the translation platform and the position of the lifting mechanism, the user gains greater control of the trainer and the magnetic resistance to pedaling. The overall attachment to the trainer includes a U-Bar 58 that extends across and around the back tire 17 to engage the rollers 54, pressing them against the back tire axle by caps 51 attached to an outer screw 56. In certain embodiments, the trainer 50 includes straps 62 for lifting the U-Bar off the back tire 17 and attaching the U-Bar to the bicycle seat.

The trainer 50 incorporates a magnetic field via a set of magnet units 60A, 60B, 60C and 60D that may be disposed about the back tire 17 with a sleeve 10. In the embodiment of FIG. 5A, the magnetic units 60 are C-shaped magnets held within a slotted stand 66. The magnetic units 60 are adjustable within the stand 66 so that the magnetic units 60 may be closer or farther from the back tire 17 and the associated magnetic elements 12 on the sleeve 10. The position of the magnetic units 60 and their proximity to the magnets 12 on the back tire 17 determine the amount of resistance to back tire revolution. The position of the magnetic units 60 in the slotted stand 66 and their proximity to the back tire 17 is adjustable by attached screws 63. Also, in operation, as the lifting mechanism 43 lifts the front tire 16 of the bicycle 40 up and down, the bicycle shifts laterally on the translation platform 55 via rollers 54. The forward and backward translation moves the back tire 17 with magnetic elements 12 disposed on a sleeve 10 into and out of proximity to the magnet units 60, creating additional increased or decreased resistance to back tire revolution. The C-Shaped example of FIG. 5A allows convenient access to the interior of the magnetic units 60 by the sleeve 10.

Figure 5B:
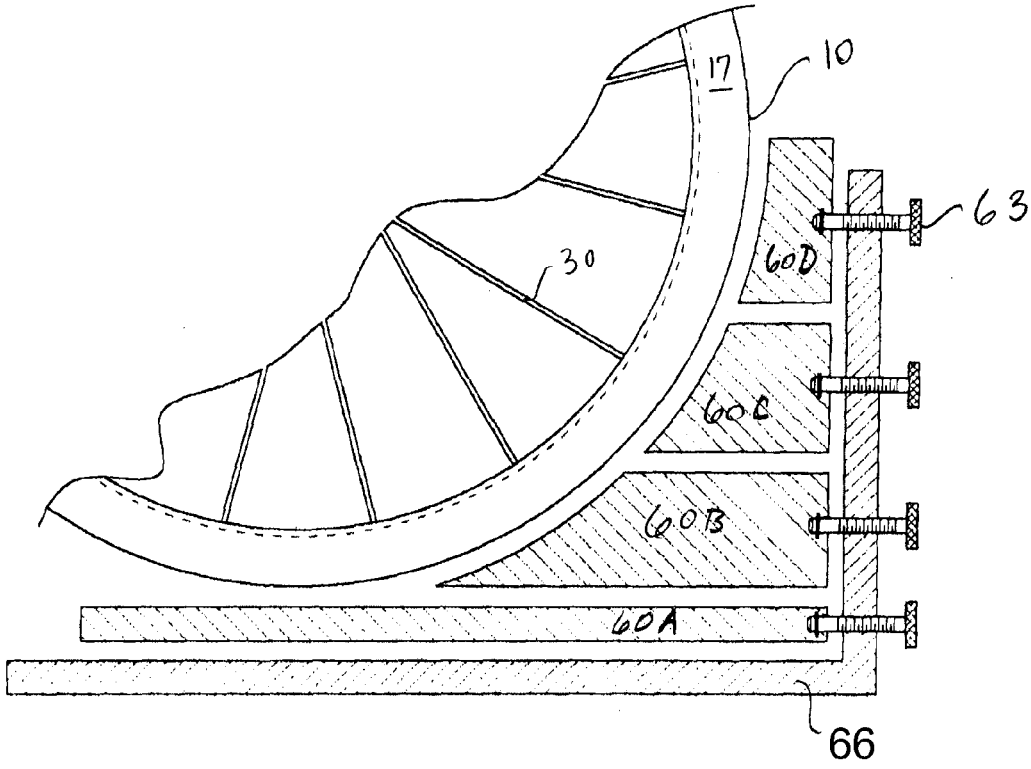
FIG. 5B is a side view of a vertical cross section of the bicycle trainer according to FIG. 5A.
Figure 5C:
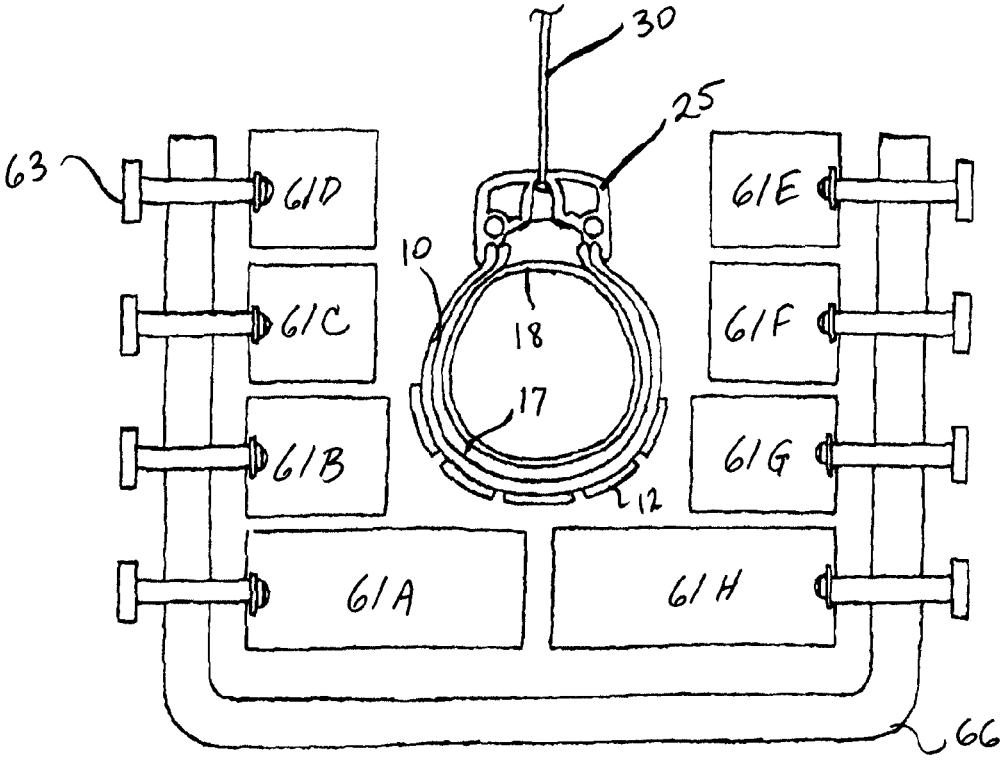
FIG. 5C is an overhead view of a horizontal cross section of a bicycle trainer having a magnetic sleeve installed on the back tire and the modular magnets surrounding the sleeve.

In FIG. 5B, the magnetic units 60A to 60D of FIG. 5A are shown in cross section as positioned behind and under the back tire 17 with a smooth magnetic sleeve 10 thereon. FIGS. 5A and 5B both provide magnetic units 60 proximate the back tire 17 of the bicycle 40 such that varying magnetic fields can be controlled and yield resistance to back tire revolution. FIG. 5C shows similar magnets 61 positioned around the sides of the magnets 12 on the back tire 17. In this way, the trainer 50 along with the magnets 12 on the back tire 17 allow an additional amount of control over the training intensity on the bicycle as the back tire 17 translates deeper into or out of the trainer magnets.

Figure 5D:
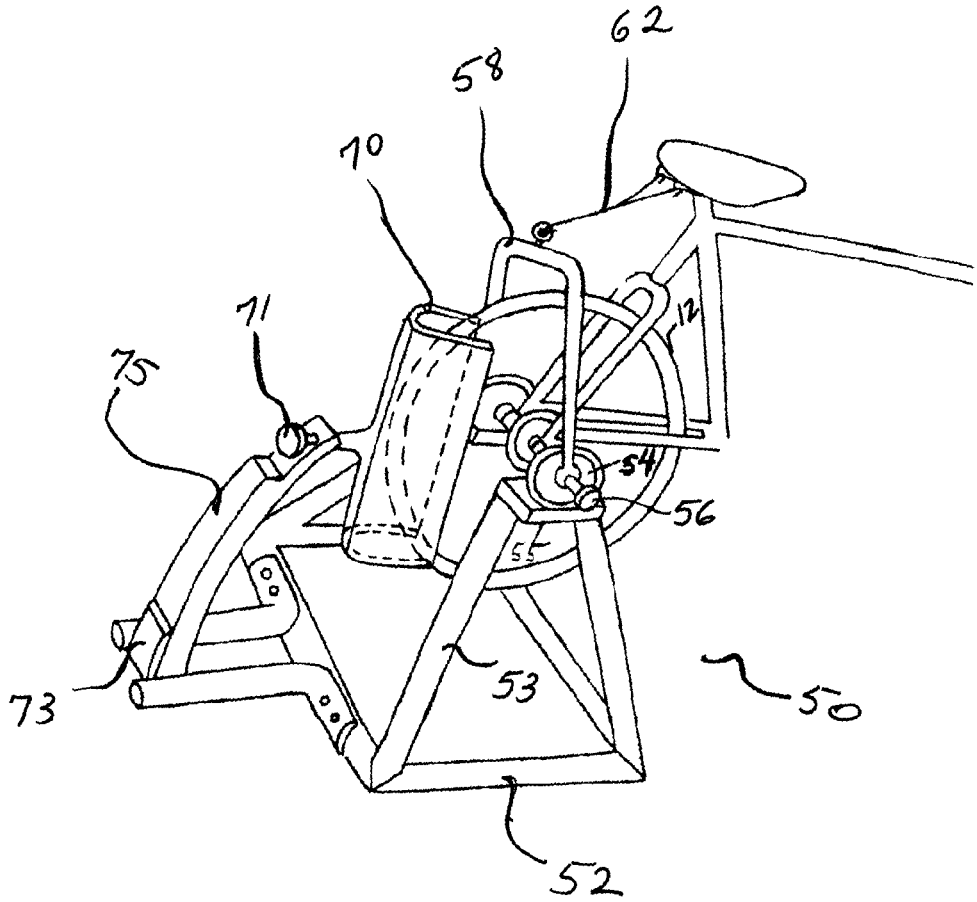
FIG. 5D is a bicycle trainer according to this invention having a back tire with a magnetic sleeve thereon in which the tire and sleeve are positioned within a magnetic arch.
Figure 5E:
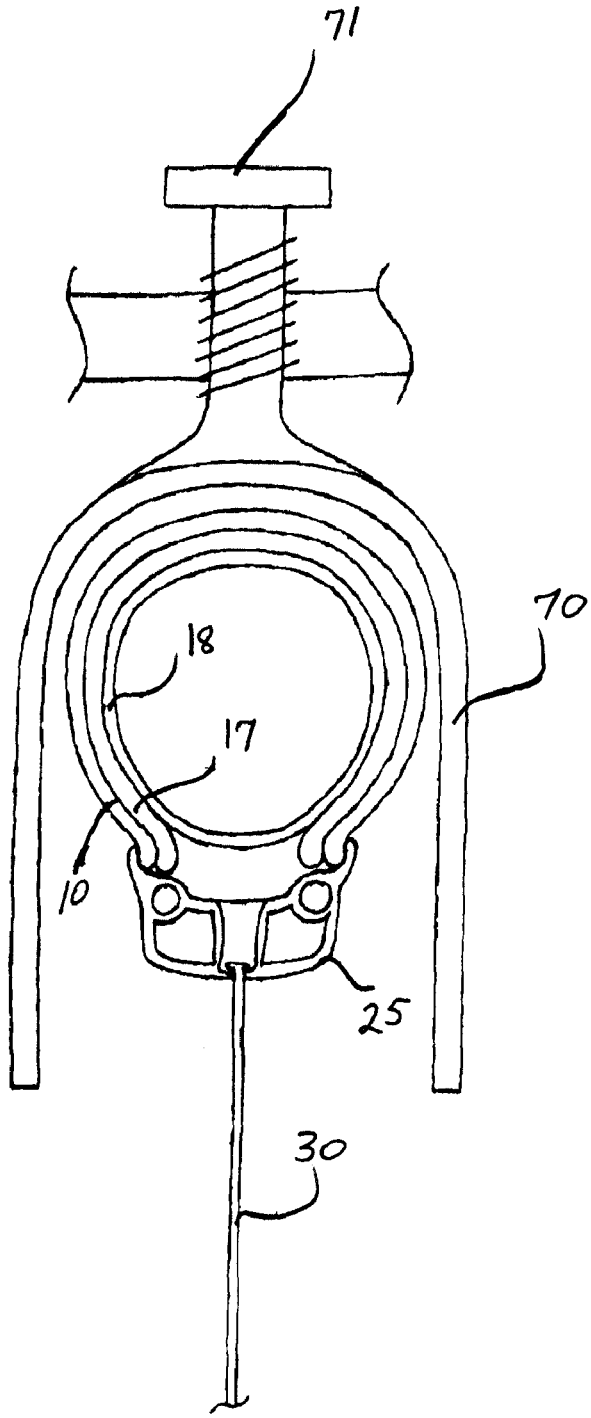
FIG. 5E is a cross sectional view of the rear tire and bicycle trainer of the invention according to FIG. 5D.

FIG. 5D is a perspective view of another way of achieving variable magnetic resistance to back tire revolution and more intense workouts by pedaling. FIG. 5D includes a bicycle 40 attached to the back tire 17 which also has magnetic elements 12 thereon, typically in the form of a magnetic sleeve 10, 33. The trainer 50 includes a magnetic component in the form of a magnetic arch 70 that defines an opening in which the back tire 17 and the associated magnetic elements 12 fit. The magnetic arch 70 provides resistance to back tire revolution. The magnetic arch 70 may be a permanent magnet or an electromagnet as known in the art. FIG. 5E shows a cross sectional view of the back tire 17 having a magnetic sleeve thereon and both fitting within the magnetic arch 70.

Figure 6A:
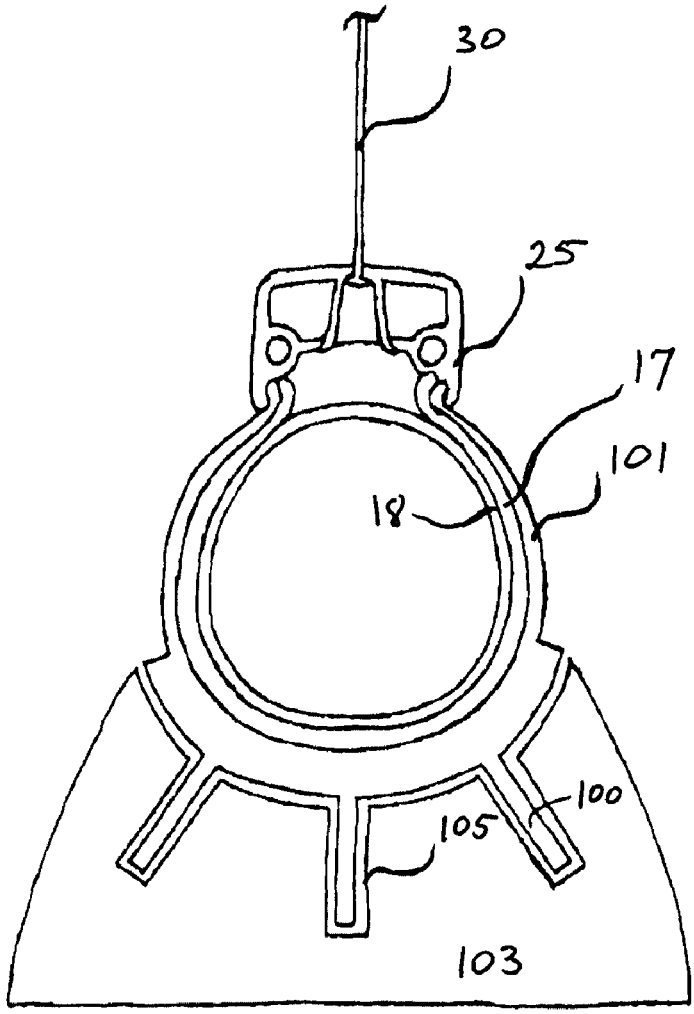
FIG. 6A is a cross sectional view of the bicycle trainer according to this invention with a sleeve installed on the rear tire of the bicycle and having magnetic fins projecting into a magnetic unit on the trainer.

One of the goals of this invention is to provide magnetic fields, typically but not limited to opposite polarity magnetic fields, that oppose back tire revolution, making pedaling more difficult for working out. FIG. 6A shows yet another embodiment for accomplishing this goal. In FIG. 6A, a sleeve 101 is installed over the back tire 17 as discussed above. In this embodiment, however, the sleeve 101 includes projections, or fins 100, that protrude from the outer surface of the sleeve 101. These fins 100 are adapted to fit into a magnetic unit 103 that, in preferred embodiments, is part of the trainer 50. Instead of the earlier described magnetic units 60 that are held around the tire 17, this embodiment provides for the fins 100 to fit within contours or grooves 105 that are opened within the magnetic unit 103 in locations that match the fins 100. Alternatively, the fins 100 could emanate from the magnetic unit 103 and fit into grooves 105 within the back tire sleeve 10. By providing magnets, typically of opposite polarity and that fit within one another, the embodiment of FIG. 6A increases resistance to back tire revolution and pedaling. This embodiment is fully functional with the electronic lifting mechanism 43 described in earlier embodiments for a fully automated and controlled work out. Again, the magnetic unit 103 or sleeve 101 with fins, is equally effective if installed as an electromagnet or as a permanent magnet. Electrical connections for electromagnets are not shown in the drawings but are available as necessary.

The sleeve 101 with fins 100 may be adjusted by determining the power of the magnets associated with the fins. In a different embodiment, the magnetic unit 103 may be installed on the trainer 50 in a way that allows for position adjustment as set forth in FIG. 5A. In other words, one way of controlling the amount of resistance to back tire revolution is by moving the magnetic unit 103 closer to or farther away from the magnets on the fins 100. The fins 100, therefore, may slide into the openings 105 within the magnetic unit 103 to varying degrees, and the interaction between the respective magnetic fields would be proportionally changed, depending on how much of the magnetic fin 100 is within the opening 105.

Figure 6B:
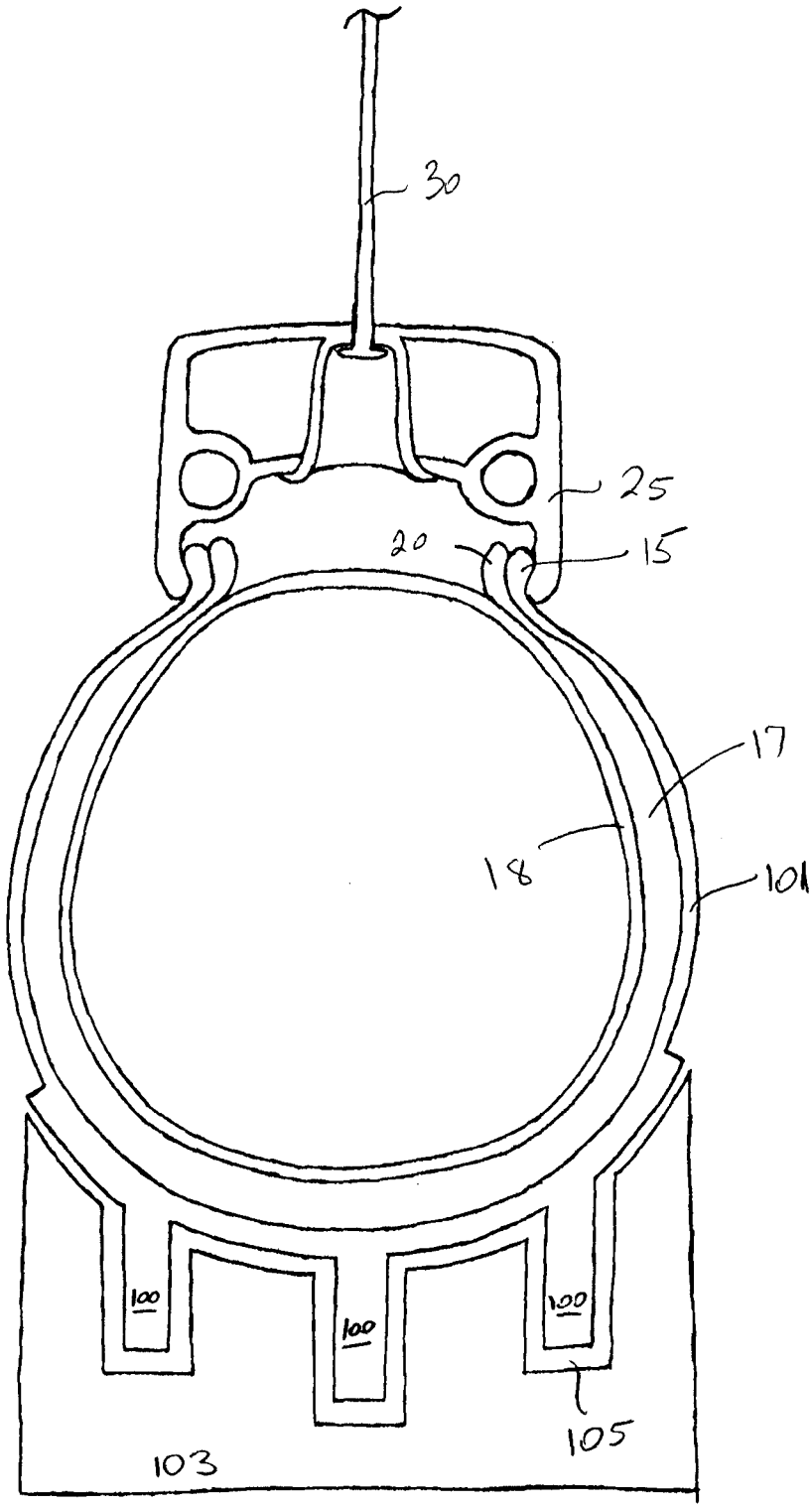
FIG. 6B is a cross sectional view of the bicycle trainer according to this invention and having fins on a magnetic sleeve that project into a magnetic unit on a trainer at an angle allowing lateral movement of the tire relative to the trainer.

The embodiment of FIG. 6B shows that the openings 105 may be substantially straight, as are the fins 100, so that a trainer 50 as shown in FIG. 5A may be adjusted to accommodate this embodiment. As discussed in regard to FIG. 5A, the trainer 50 includes lateral translation platforms 55 allowing the bicycle to move back and forth as the lifting mechanism 43 moves the front tire up and down. When combined with the magnetic unit 103 of FIG. 6B, the trainer 50 that accommodates lateral translation of the bicycle 40 would also be suited to control the amount, or length, of the fins 100 fitting into the opening 105. Accordingly, the embodiment of FIG. 6B adds an additional control element for customizing a workout in the form of varying magnetic resistance to pedaling by placing more or less of the fin 100 into the magnetic unit opening 105. In accordance with other embodiments described above, the magnetic unit 103 may be held in a stand or other holder associated with the trainer. The position of the magnetic unit 103 would then be adjustable by a screw type mechanism associated with the stand.

Figure 6C:
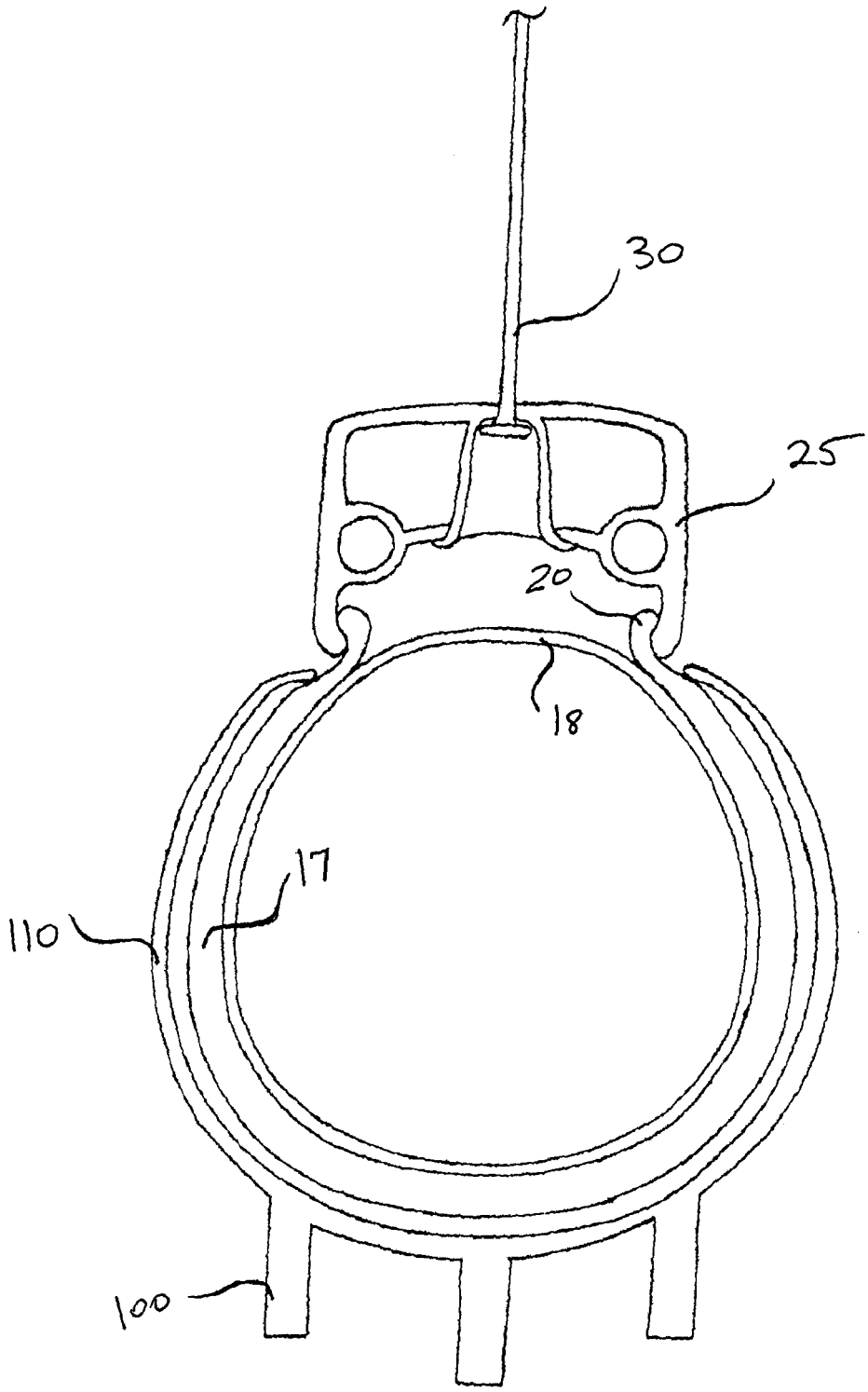
FIG. 6C is a cross sectional view of a magnetic clip with fins according to this invention.

In an even more convenient embodiment of the fin mechanism of FIGS. 6A and 6B, FIG. 6C shows that the magnetic fins 100 may be attached to the back tire 17 via a clip 110 that fits around the back tire and attaches just above the rim 25. In a different embodiment, the clip may include a bead on each end that fits within the rim. FIG. 6C shows that a standard bicycle 40 includes an inner tube 18 inflated within a back tire 17 attached to the bicycle rim 25 by a bead 20. The clip may be made of any material that allows the clip 110 to stretch around the tire 17 so that fins 100 project outwardly (e.g., elastomeric polymers and metal alloys). Again, the fins 100 include magnetic elements having a magnetic field that is useful in controlling a variable resistance to back tire revolution. The fins 100 fit into the opening, or grooves, in the magnetic unit 103 of FIG. 6B. By way of comparison, the clip feature could be used in any of the embodiments described herein. For example, the clip 110 may not include fins at all, but instead, the clip may be a smooth magnetic element placed about the back tire 17. A smooth clip 110 of this additional embodiment may be used in conjunction with the magnetic arch 70 described above.

As described in detail above, a trainer 50 includes the appropriate mechanisms for simulating a controlled training route by attaching a standard bicycle 40 to the trainer 50. The front lifting mechanism 43 is mechanically fitted for varying the height of the front tire 16 according to the user's preferences. In a particularly useful embodiment, the lifting mechanism 43 includes the appropriate electronic control circuitry, such as a height controller, and power supplies (not shown) to read computer programmed information from a computer storage medium, such as a CD-ROM. In a preferred embodiment, the CD-ROM enables the user to simulate a real world course by controlling the horizontal and vertical movement of the bicycle. Combined with the variable magnetic resistance to back tire revolution described herein, the trainer 50 provides a training experience closer to that experienced on real world tracks.

Figure 7A:
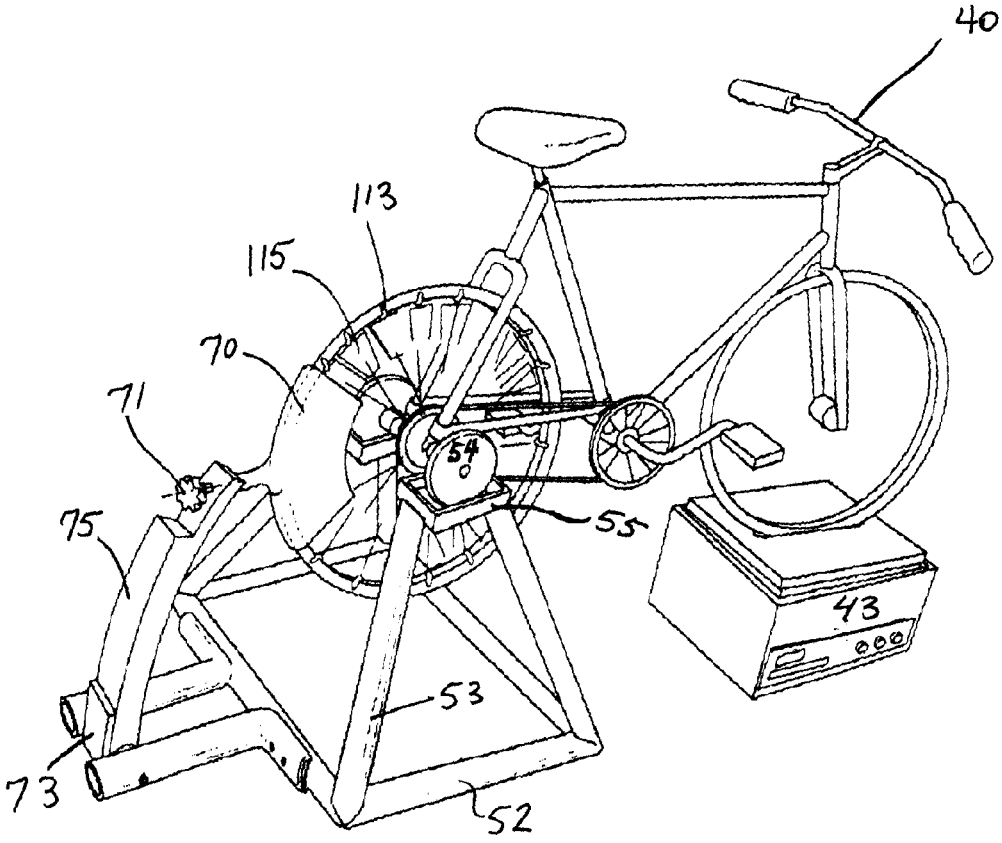
FIG. 7A is a perspective view of a bicycle trainer having a magnetic arch on the trainer that fits around the rear tire of a bicycle having magnets disposed on the back tire spokes.

FIG. 7A continues along the line of trainers similar to that described above but with a new design for the magnetic unit 70 and the attachment of the magnets to the back tire 17. The magnetic unit 70 of FIG. 7A is in the form of a magnetic arch 70 that receives and encompasses at least a portion of the back tire 17. The goal of this embodiment is similar to that above. Magnetic fields from the back tire 17 and from the magnetic arch 70 combine to provide resistance to back tire revolution. In preferred embodiments, the magnetic fields have opposite polarity so that attraction between the back tire 17 and the magnetic arch 70 hinders pedaling due to resistance to back tire revolution.

In a most preferred embodiment of FIG. 7A, the magnetic field emanating from the back tire 17 is created by magnetic spoke elements 115 that attach to the spokes 30 of the back bicycle tire 17. The magnetic spoke element 115 may be in the form of a flat plate or shield with magnets attached thereto, or even formed entirely of magnetic material. The magnetic spoke element 115 may have a groove down one side for engaging a spoke and a rim clip 113 on one end for engaging the bicycle rim 25. The rim clip 113 adds stability to the magnetic spoke element 115 and holds it in place when the magnetic spoke element 115 is placed within another magnetic field. In other words, the rim clip 113 prevents any tendency for the magnetic spoke element to rotate about the spoke.

Figure 7B:
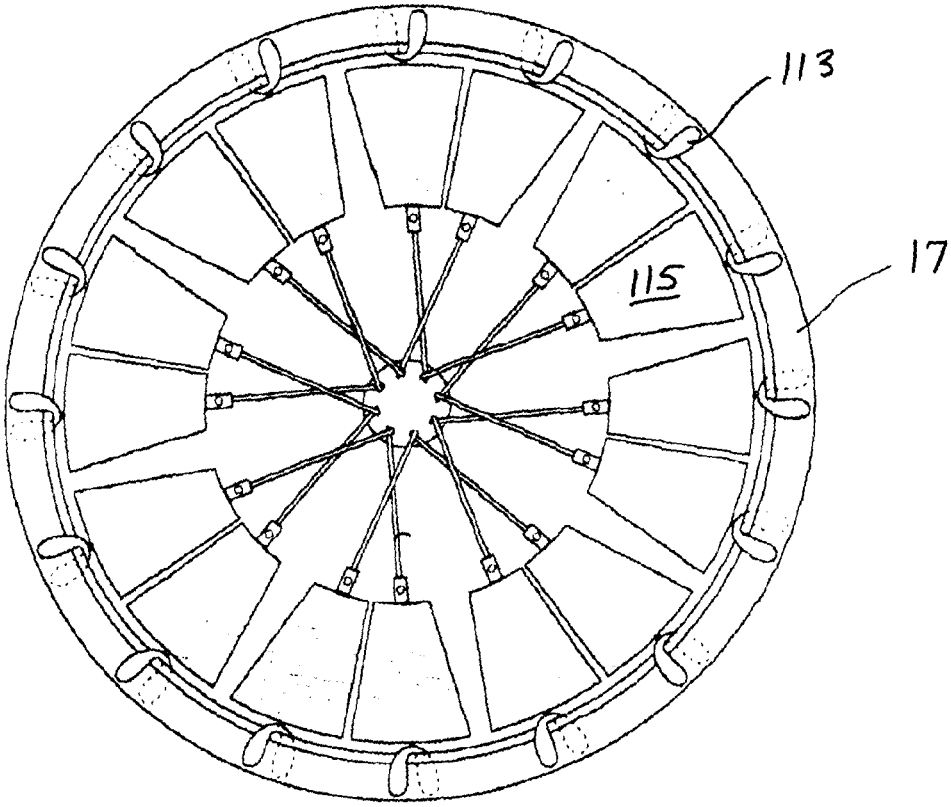
FIG. 7B is a perspective view of the back bicycle tire in use on the trainer of FIG. 7A.
Figure 7C:
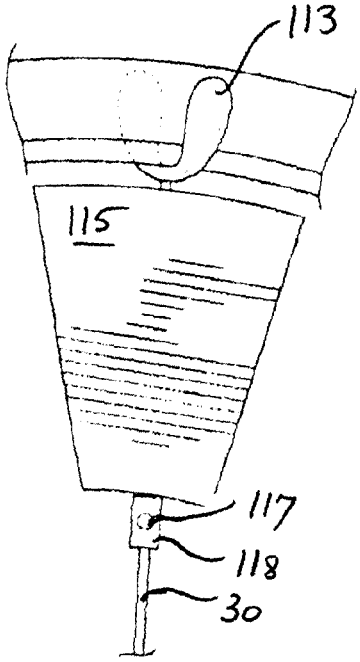
FIG. 7C is a close up view of one of the magnets installed on a spoke of the back tire of FIG. 7A.
Figure 7D:
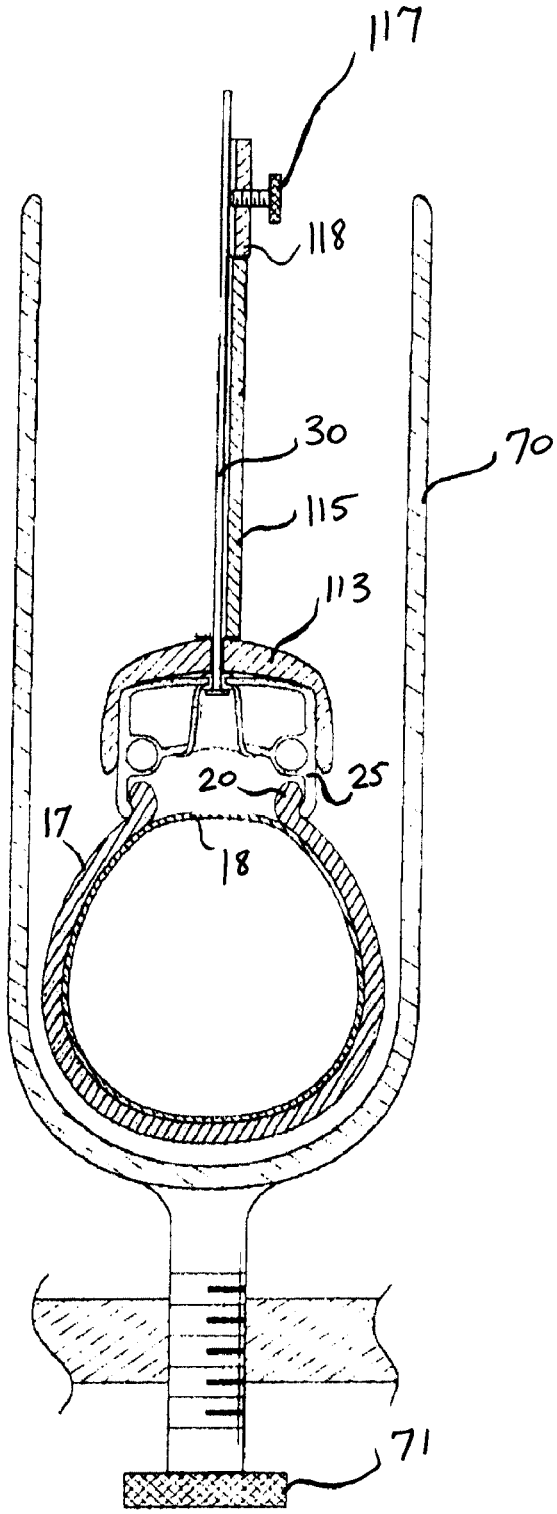
FIG. 7D is a cross sectional view of the bicycle trainer and bicycle tire shown in FIG. 7A.

In practice, the trainer 50 of FIG. 7D operates similarly to the embodiments described above with features allowing for vertical and horizontal translation. As the lifting mechanism 43 moves the bicycle up and down, the rollers 54 allow for forward and backward translation on the translation platforms 55. It should be noted that for drawing purposes, FIG. 7A omits the U-Bar 58, screws 56, and caps 51 associated with the rear axle for attaching the bicycle to the trainer 50. The trainer of FIG. 7A, however, may include those features just as described in regard to earlier figures. Similar to adjusting the surface area of magnetic elements on the sleeve 10, as the bicycle of FIG. 7A moves forward and backward, the amount of surface area of the magnetic spoke element 115 positioned within the magnetic arch 70 changes. The more surface area of the magnetic spoke element 115 within the magnetic arch 70, a greater amount of resistance to pedaling is present.

FIG. 7A shows that the magnetic arch 70 is positioned on a substantially vertical trainer bar 75. The horizontal center of the magnetic arch may be adjusted by adjustment screw 71 which moves the magnetic arch 70 forward and backward, i.e., parallel to a horizontal surface supporting the overall trainer 50. Again, the goal is to use varying positions of the magnetic arch to vary the interaction between magnetic fields emanating from the magnetic arch 70 and the magnetic spoke elements 115. Overall, the trainer 50 of FIG. 7A provides variable resistance and a controlled training experience by allowing the user to experience a training circuit that causes the bicycle to move up and down and forward and backward with magnetically varied resistance to back tire revolution.

FIG. 7B shows a close up view of the magnetic spoke elements 115 attached to spokes 30 on a side opposite that shown. The rim clips 113 stabilize the magnetic spoke elements 115. FIG. 7C shows another embodiment that provides even more stabilization to the magnetic spoke elements 115. FIG. 7C includes a spoke receptacle 118 clipped around the spoke 30 and having a passageway for a spoke screw 117. A spoke screw tightens into the spoke receptacle 118 and braces against the spoke 30. The spoke screw 117 then prevents the magnetic spoke element 115 from sliding up and down the spoke 30.

FIG. 7D shows a cross sectional view of the magnetic spoke element 115 positioned on a spoke 30 via a groove in one side of the magnetic spoke element 115. The rim clip, 113, spoke screw 117 and spoke receptacle 118 stabilize the magnetic spoke element as it moves into and out of the opening defined by the magnetic arch 70. Keeping in mind that the position of the magnetic arch 70 can be adjusted by adjustment screw 71, the trainer 50 associated with FIG. 7D allows for magnetic resistance between the magnetic spoke element 115 and the magnetic arch 70 to influence the resistance to pedaling that a rider experiences on the trainer 50. The magnetic arch 70 may be formed in numerous shapes with varying contours adapted to adjust the interaction of the applicable magnetic fields.

Figure 7E:
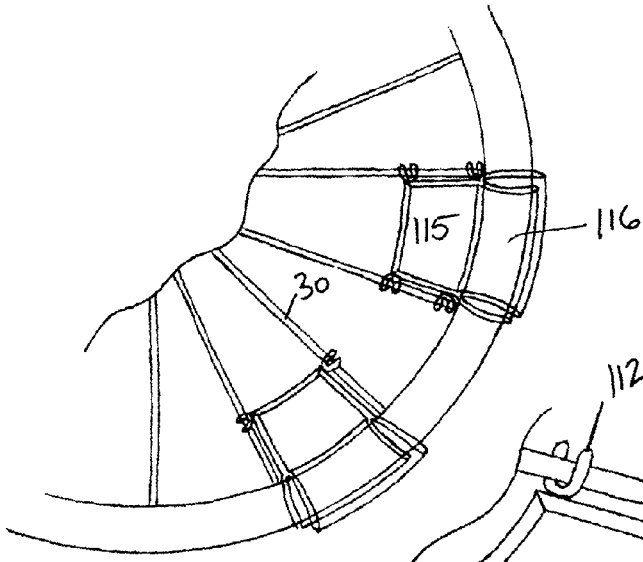
FIG. 7E is a perspective view of a bicycle tire for use with the trainer of FIG. 7A and having a magnetic spoke element clipped to the rim of the bicycle tire and rear tire spokes.
Figure 7F:
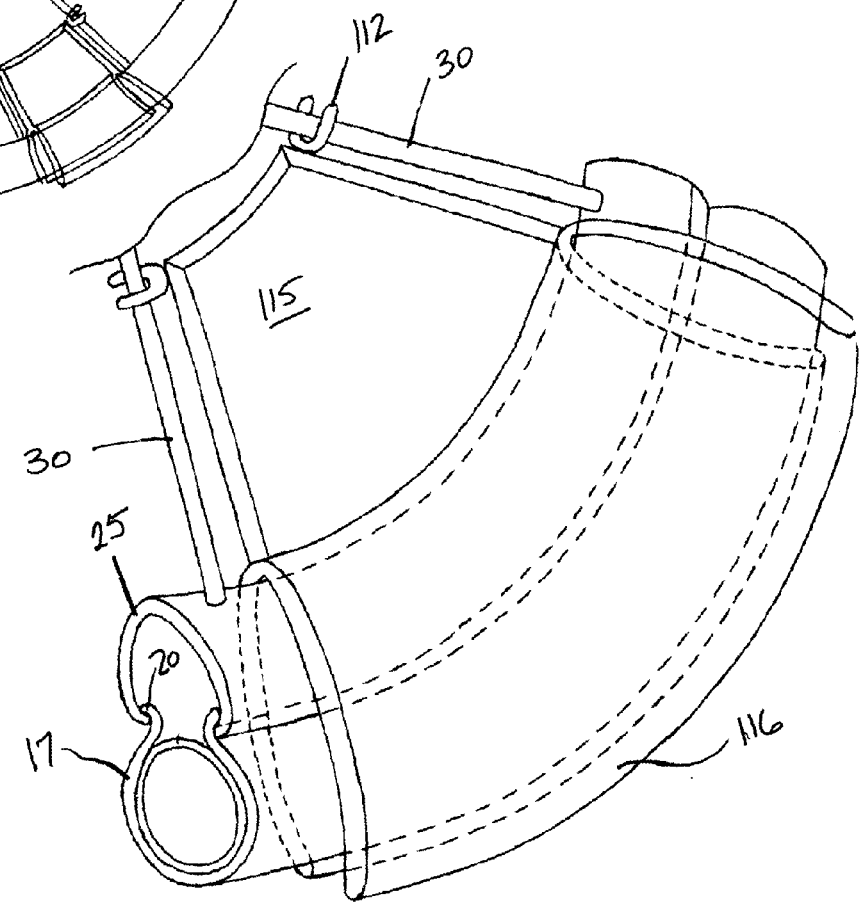
FIG. 7F is a close up view of the magnetic spoke element of FIG. 7E.

FIGS. 7E and 7F illustrate yet another embodiment of the magnetic trainer of this invention. In FIG. 7E, magnetic spoke element 115 extends between two spokes and is attached to each. Although the figure shows a flat planar attachment, the actual magnetic spoke element 115 is attached entirely on one side of the back tire 17 by connecting to spokes lying in the same plane substantially parallel to the back tire. In a preferred embodiment, the magnetic spoke element 115 is complemented with a magnetic rim clip 116 for added magnetic field strength. In the embodiments shown in FIGS. 7E and 7F, the magnetic components 115, 116 may be used at the same time or individually as the user chooses.

Figure 8A:
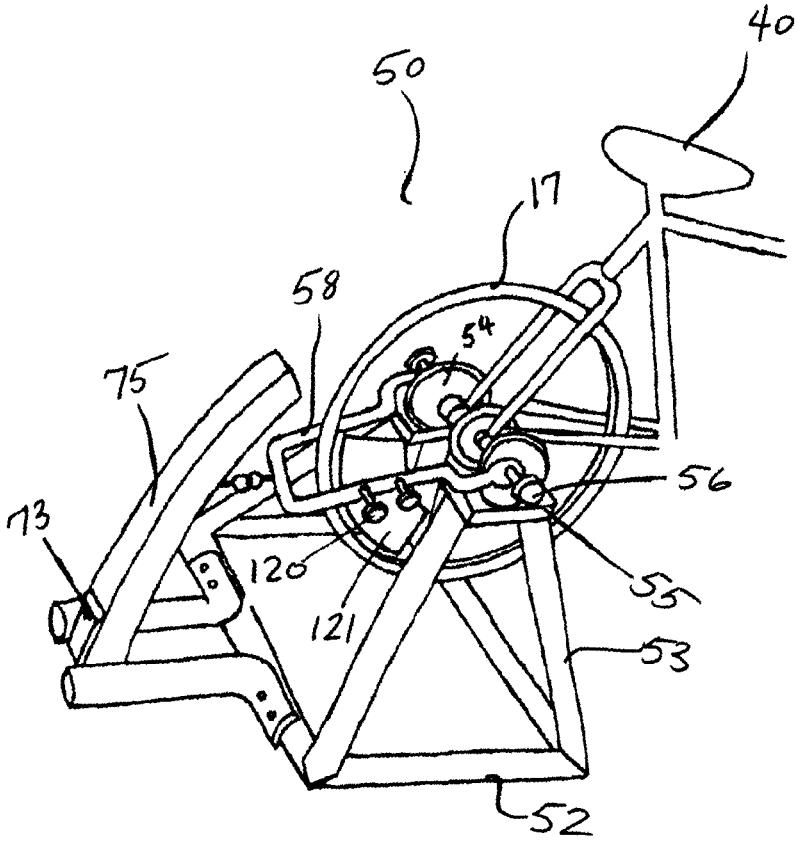
FIG. 8A is a perspective view of a bicycle trainer according to this invention with a U-Bar having magnets disposed on the U-Bar and on the back tire of the bicycle.

The magnetic trainer 50 set forth herein uses two magnetic components for functionality-one on the bicycle tire and one on the trainer. FIGS. 8A to 8F show an embodiment of the magnetic component 121 on the trainer 50 that can be used with any of the magnetic components described above for attaching to the back tire. As noted above, the trainer 50 attaches to the bicycle by placing rollers 54 on the back tire axle and then using caps 51 to attach a U-Bar 58 across and around the back tire 17. As shown in FIG. 8A, a magnetic component 121 may be attached to the U-Bar 58 that holds the bicycle 40 in place on trainer 50. The proximity of the U-Bar magnetic component 121 to magnets on the back tire can be used to vary the resistance to pedaling. Although the magnetic components on the tire are not shown in FIG. 8A, the U-Bar magnetic component 121 is particularly effective with the magnetic spoke elements shown in FIG. 8A. A more convenient configuration of this embodiment may include two U-Bars 58 with one attaching the rollers 54, caps 51, and screws 56 to the back tire axle for translation of the bicycle. A second U-Bar 58 would then hold the magnetic component 121. In additional embodiments, the U-Bar 58 may be contoured to position magnetic components closer or farther away from the back tire 17.

Figure 8B:
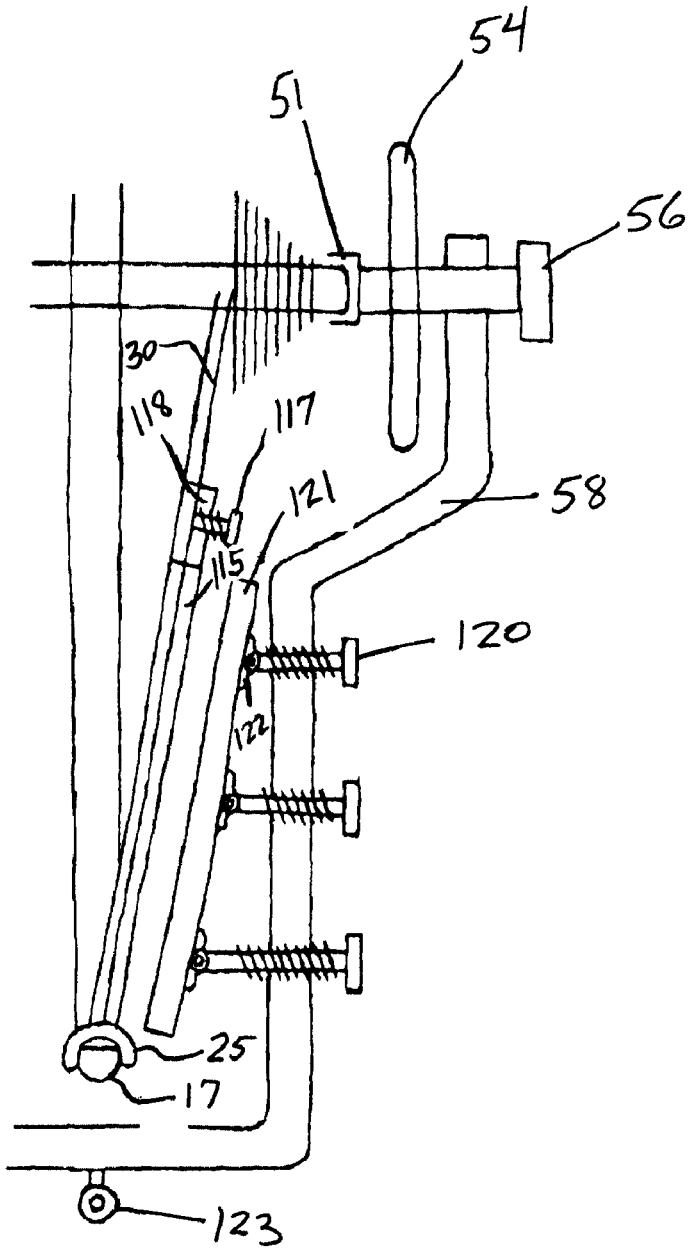
FIG. 8B is a cross sectional view of the bicycle trainer of FIG. 8A with magnets on the trainer and on the bicycle tire spokes.
Figure 8C:
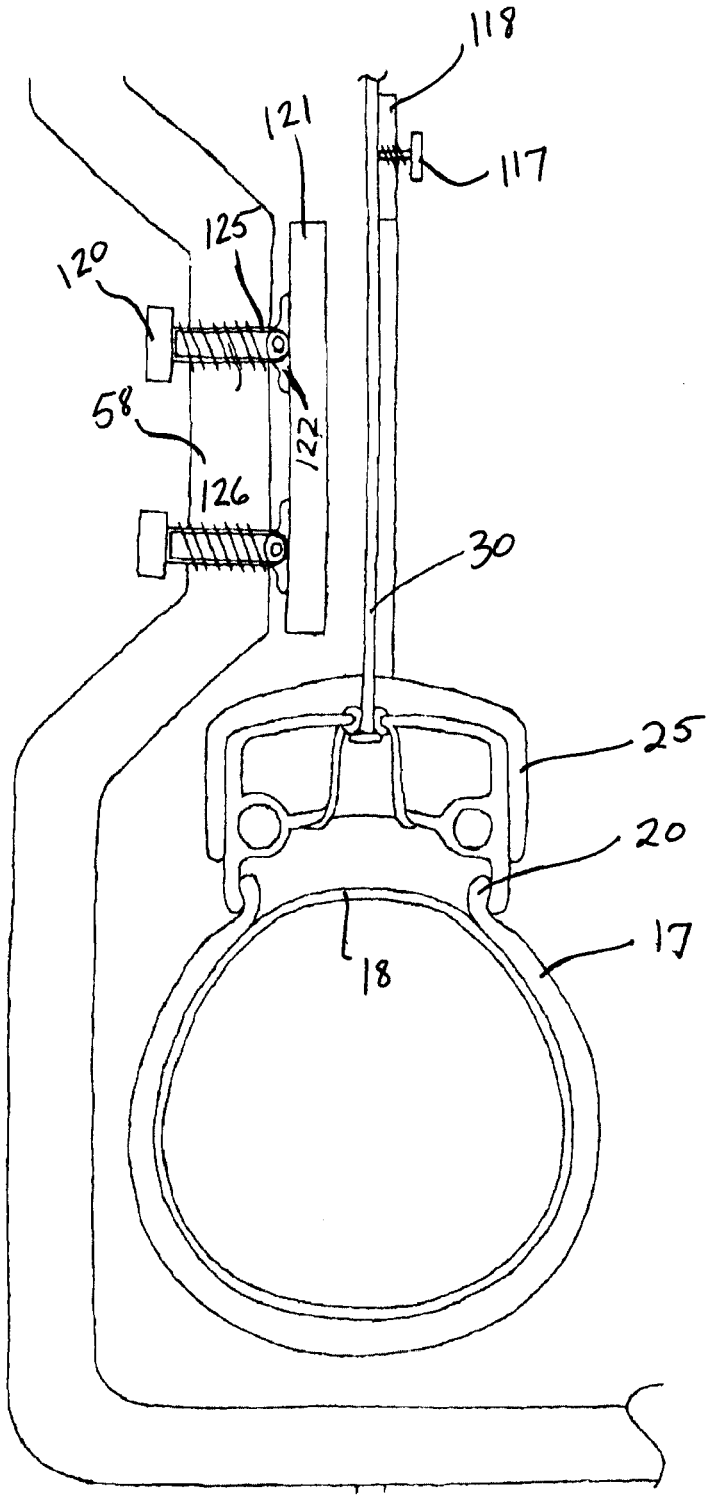
FIG. 8C is a close up view of the U-Bar and back bicycle tire of FIG. 8A with magnets disposed on the U-Bar and the rear tire spokes.
Figure 8D:
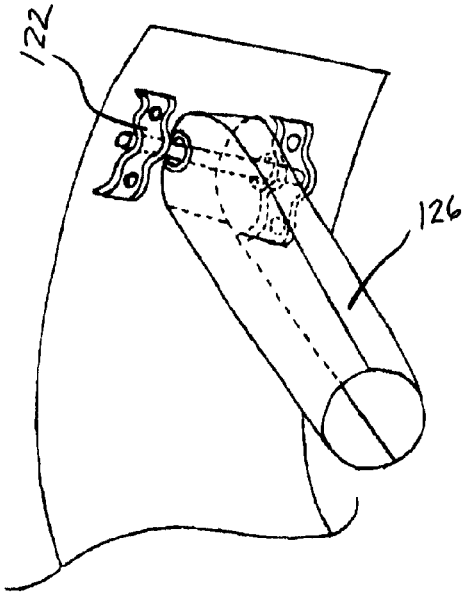
FIGS. 8D-8F show individual views of attachment mechanisms for placing magnets on the U-Bar of FIG. 8A.
Figure 8E:
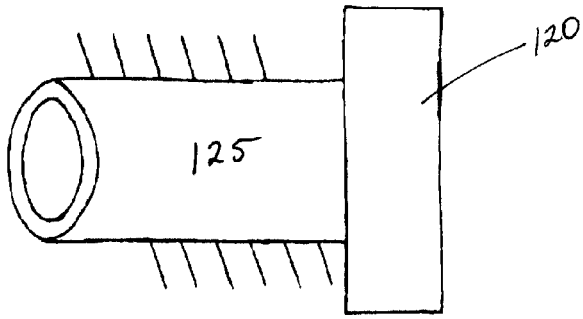
Figure 8F:
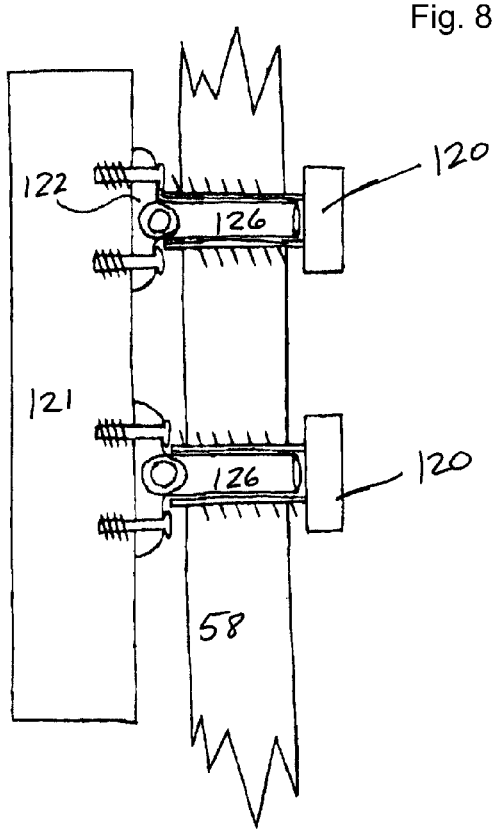

FIG. 8B shows the U-Bar magnetic element 121 attached to the U-Bar 58 by hollowed screws 120 and brackets 122. The magnetic spoke element 115 fits onto the spoke 30 just as described above. FIGS. 8C to 8F show the individual mechanical features that may be used to attach the U-Bar magnet 121 to the U-Bar 58. In a preferred embodiment, the U-Bar magnet 121 incorporates a pin 126 attached thereon by brackets 122. The pin 126 is adapted to fit into a hollowed U-Bar screw 120. The hollowed U-Bar screw 120 fits through a bore in the U-Bar 58, attaches to the pin 126 on the U-Bar magnet 121, and secures the U-Bar magnet 121 to the U-Bar 58. Another possible modification is to accommodate a locking mechanism (not shown) onto the U-Bar screw 120. For example, the U-Bar screw head may be hollow, allowing the pin 126 to extend all the way through the screw. A lock, such as a sliding fastener, may engage both the screw 120 and the pin 126. Accordingly, the illustrations of FIGS. 8C to 8F represent just one possible embodiment of magnetic elements attached to the trainer U-Bar 58.

Figure 9A:
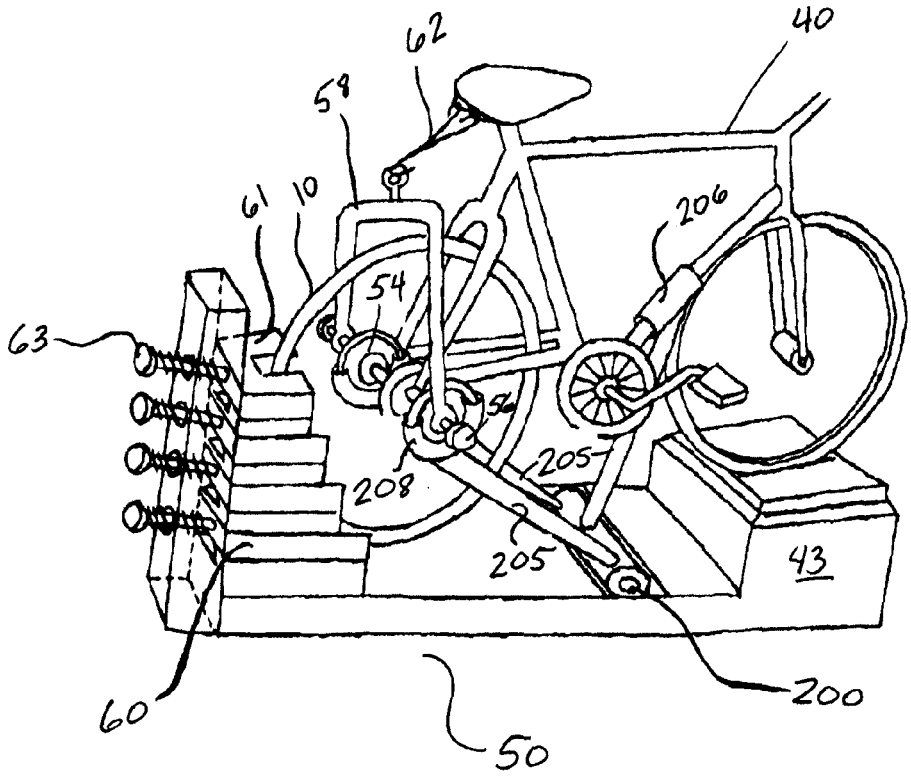
FIG. 9A shows a bicycle trainer according to this invention by which a front lifting mechanism moves a front tire up and down as a tilting mechanism adjusts the position of the rear tire and associated magnets into and out of a magnetic trainer.
Figure 9B:
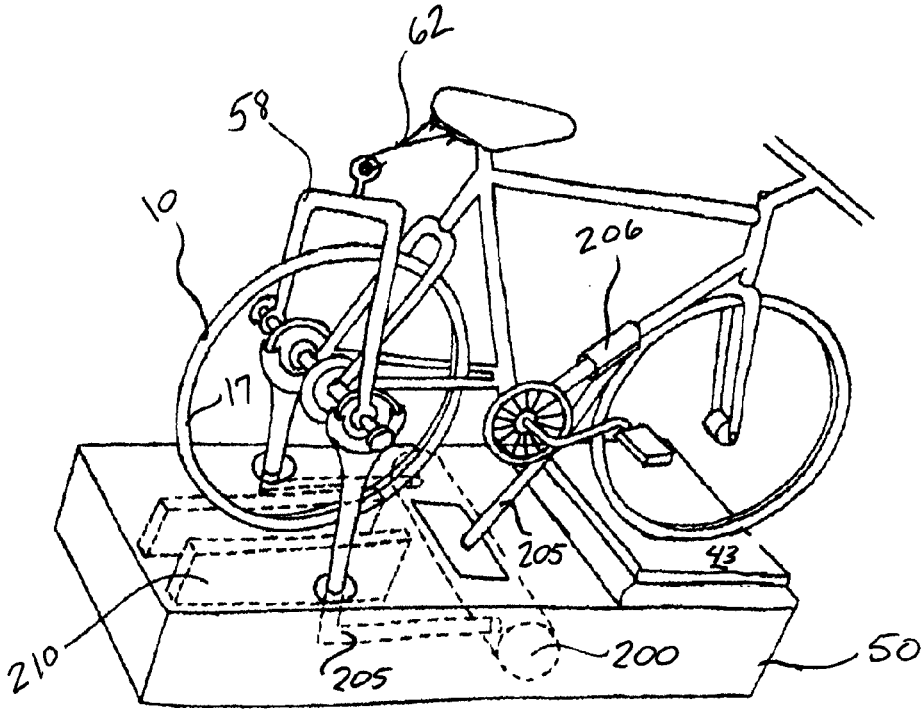
FIG. 9B shows a bicycle trainer according to this invention having a tilting mechanism that adjusts the position of a bicycle having a magnetic back tire lifted into and out of the magnetic field between plates associated with the trainer.
Figure 9C:
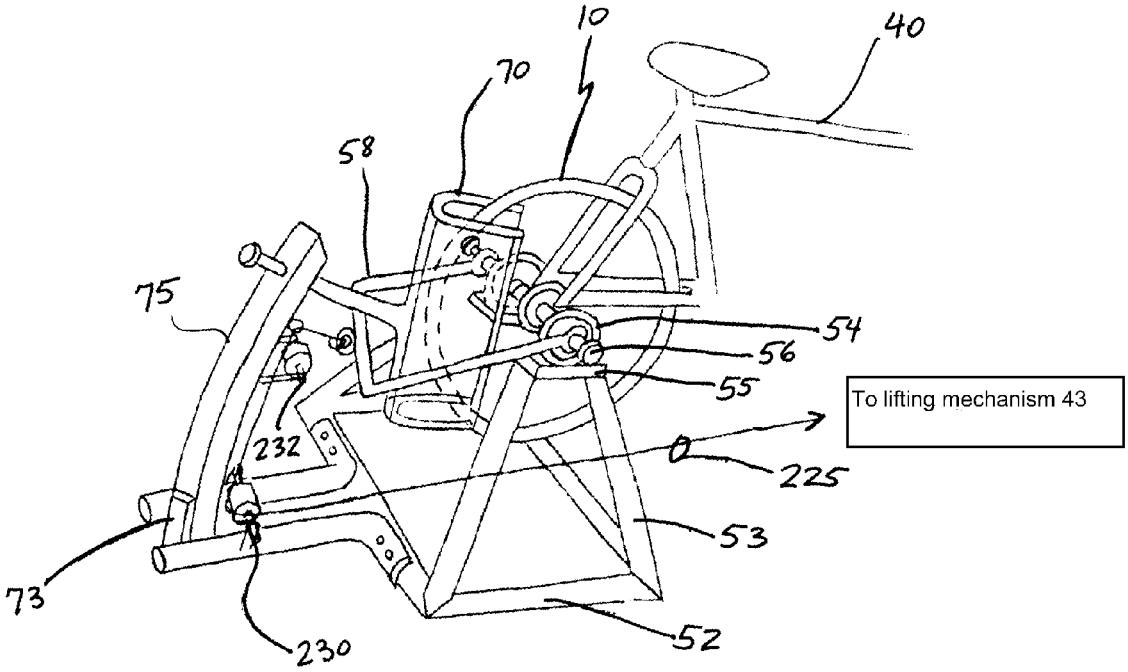
FIG. 9C is a bicycle trainer according to this invention having a back tire with a magnetic mechanism positioned by a pulley system within a magnetic arch on the trainer.
Figure 10:
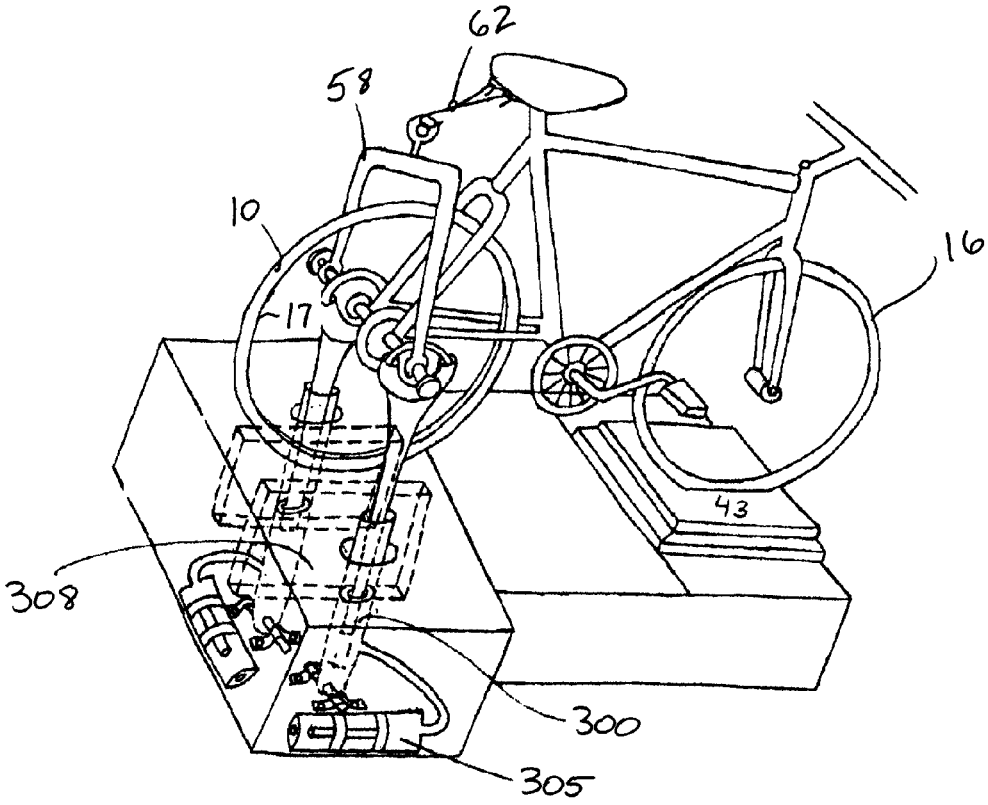
FIG. 10 is a bicycle trainer according to this invention and having hydraulic components for moving the back tire of a bicycle and associated magnets into and out of the magnetic field associated with magnetic plates within the trainer.
Figure 11:
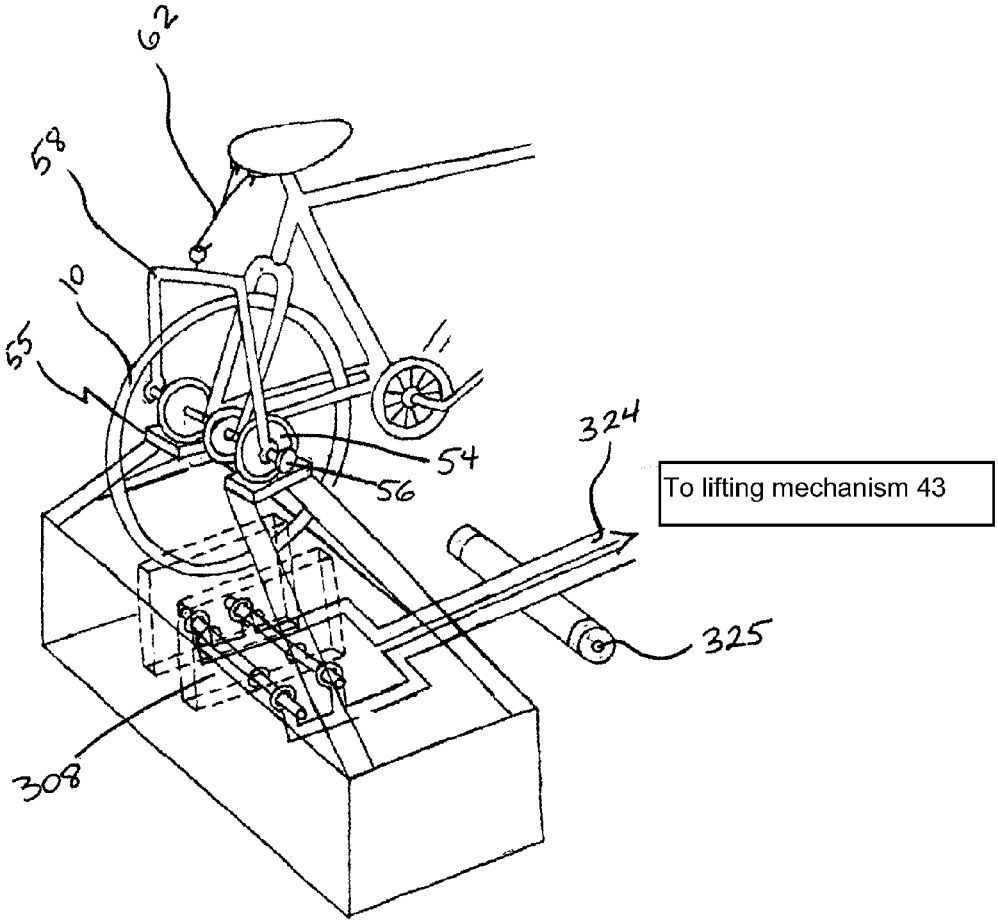
FIG. 11 is a bicycle trainer according to this invention moving magnetic plates within the trainer into and out of the magnetic field associated with magnets on the back tire.

The embodiments of FIGS. 9 to 11 incorporate the variable magnetic resistance concept described herein to certain embodiments of the bicycle trainer disclosed in U.S. patent application Ser. No. 12/206,696, incorporated by reference to this written description. In FIG. 9A, the magnetic units 60, described above in regard to FIG. 5A, are used along with the lifting mechanism 43 and magnetic elements 12 on the back tire 17 attached by a sleeve 10 (again described above). Similarly, as shown in FIG. 5D, a magnetic arch 70 would provide equivalent functionality on the trainer 50. The bicycle 40 attaches to the trainer 50 via an arrangement of rollers 54 and caps 56 tightened onto the rear axle through U-Bar 58. The difference in this embodiment lies in its support rods 205 that connect to the bicycle frame and the trainer 50 by gripping cups 206, 208. Cup 206 is shown in FIG. 9A as clamping around the bicycle frame, and cups 208 engage the rollers 54. In a sense, the support rods 205 suspend the bicycle 40 in the air except for support from the lifting mechanism 43. The support rods 205 pivot about a central axis 200. As the lifting mechanism 43 moves up and down, the support rods 205 and pivot 200 allow the bicycle to rock, or tilt, back and forth in an arcuate pattern about the pivot 200. In this way, the magnetic elements on the back tire (i.e., the sleeve 10) move in and out of proximity to the C-shaped magnetic units 60 for variable magnetic resistance to pedaling. The amount of resistance to pedaling is determined by the extent to which the magnetic field emanating from the back tire 17 (via sleeve 10) interacts with the magnetic field emanating from the trainer 50 (via magnetic units 60).

The embodiment of FIG. 9B also uses support rods 205 to tilt the bicycle back and forth about the pivot 200. In this case, however, the back tire 17 and magnetic sleeve 10 move in and out of the magnetic field created by plates 210 positioned within the trainer 50. As shown in the drawing, the magnetic plates 210 are accessible only within the trainer body such that the back tire 17 and sleeve 10 slide between the plates 210 via an opening in the trainer body (not shown). Again, the lifting mechanism 43 determines, at least in part, the extent to which the back tire 17 and sleeve 10 extend within the magnetic plates 205.

FIG. 9C is an additional embodiment that uses the cable style trainer disclosed in the previously incorporated U.S. patent Ser. No. 12/206,696 (Hamilton 2008). The cable 225 is adjusted according to the lifting mechanism 43 position and pulls the bicycle 40 back and forth on translational platforms 55 via pulleys 230, 232. The cable 225 is attached to U-Bar 58 and allows the magnetic units 12 on the back tire 17 to move in and out of position within magnetic arch 70. Again, the goal is to have dual magnetic fields between the back tire 17 and the trainer 50 controlled by the position of the bicycle on the platforms 55. The bicycle position in the embodiment of FIG. 9C is determined to a large extent by the vertical position of the front tire on the lifting mechanism. The lifting mechanism 43 reels the cable in and out according to a control system programmed into the electronics of the lifting mechanism. The rest of this embodiment works substantially similarly to that of FIG. 7A wherein the variable resistance to pedaling is determined by the position of the back tire 17 and the magnetic elements 12 thereon within the magnetic arch 70.

FIG. 10 is also supported in part by the invention disclosed and claimed in co-pending U.S. patent Ser. No. 12/206,696 (Hamilton 2008). In this embodiment, hydraulics 305 are used to lift the back tire 17 and the magnetic sleeve 10 thereon into and out of the magnetic field of magnetic plates 308 within the body of the trainer 50. Although it is not shown in the figure, the trainer 50 may include an opening through which the back tire 17 moves up and down between the magnetic plates in the trainer. Again, the magnetic fields, typically of opposite polarity, will add to the resistance a rider faces to pedaling the back tire 17. As the bicycle tire 17 with magnetic elements 12 thereon moves deeper into the magnetic field of the plates 308, more of the magnetic field associated with the back tire 17 interacts with the magnetic field of the back tire 17, making pedaling more difficult. Without limiting the invention, one goal of this embodiment is to allow for a programmable training course to be set forth in the electronic system of the lifting mechanism 43, and data communication between the lifting mechanism 43 and the hydraulics 305 determines the relative position of the front tire 16, back tire 17, as well as a first magnetic unit on the plates 308 of the trainer and the second magnetic unit on the back tire 17 of the bicycle.

The hydraulic lifts 300 are coupled to the back tire 17 by attachment cups that engage the back axle via a roller assembly similar to that described above. Without repeating the above descriptions of the lifting mechanism 43, suffice it to say that a control system (e.g., a computer controlled means of adjusting bicycle position) can adjust the height of the front tire 16 and the height of the back tire 17 by connecting hydraulics 305 and lift 43 through computerized control circuitry. In this way, the magnetic fields adjust the resistance to pedaling.

FIG. 11 is yet another embodiment of the invention and uses a lever mechanism 324 to lift the magnetic plates 308 into and out of the trainer body 50 through an opening in the trainer 50. The back tire 17 of FIG. 11 includes a sleeve 10 having magnetic elements 12 thereon. The magnetic plates 308 may be lifted up and down into the magnetic field emanating from the back tire 17 to control the resistance to pedaling. By lifting the magnetic plates 308 up and down, the back tire 17 of the bicycle 40 and the associated magnets on the back tire may remain vertically stable while moving laterally (horizontally parallel to the underlying support surface) on the translation platforms 55.

In one embodiment, the back tire 17 may be substantially stationary (other than revolution about the axle) with the position of the magnetic plates 308 in relation to the magnets on the back tire 17 determining the resistance to pedaling. The lever embodiment of a bicycle trainer is fully disclosed and incorporated by reference above to U.S. patent Ser. No. 12/206,696 (Hamilton 2008). As noted therein, a lifting mechanism 43 raises and lowers the front tire 16 of the bicycle 40 in accordance with the user's training circuit (described similarly above). As the lifting mechanism 43 operates vertically, mechanical attachments (not shown) cause the lever 324 to raise and lower the magnetic plates 308 about the pivot 325.

Figure 12A:
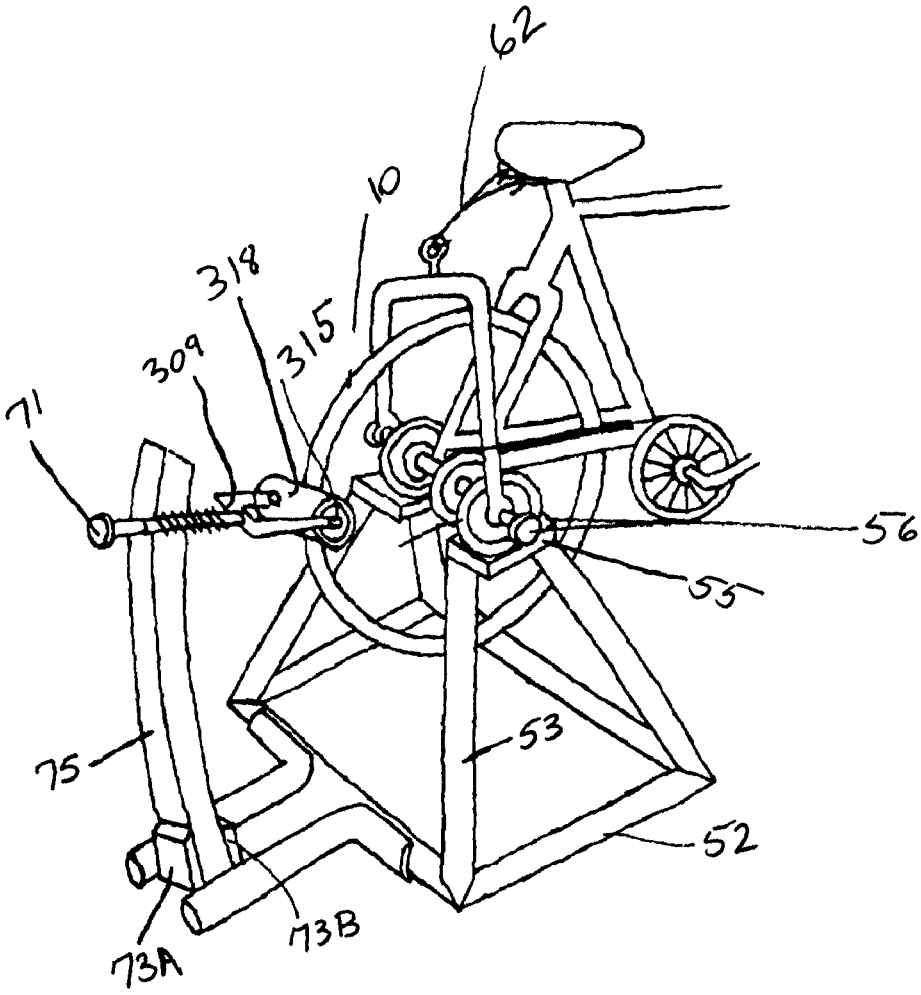
FIG. 12A is a bicycle trainer according to this invention with magnetic elements disposed on the back tire of the bicycle and a magnetic cylinder on the trainer for engaging the magnetic field of the back tire.
Figure 12B:
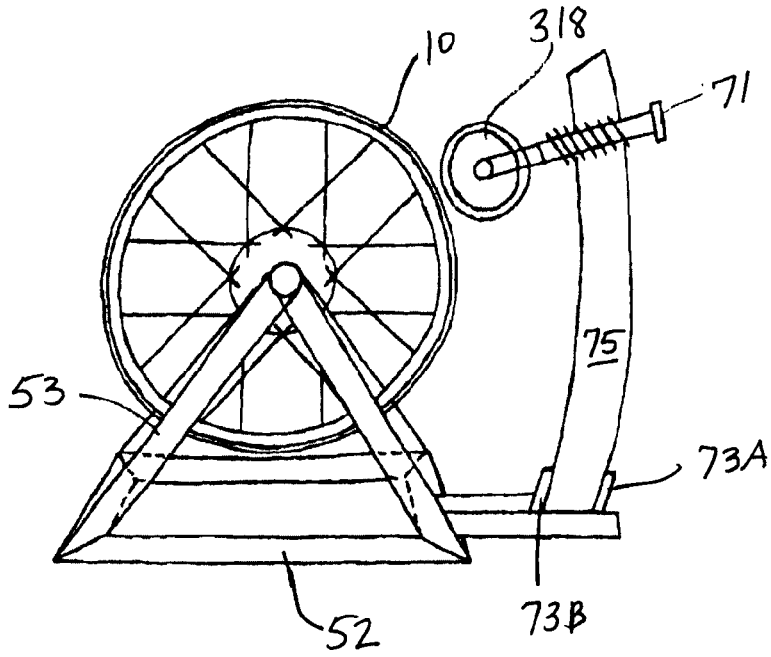
FIG. 12B is a side view of the bicycle trainer according to FIG. 12A.
Figure 12C:
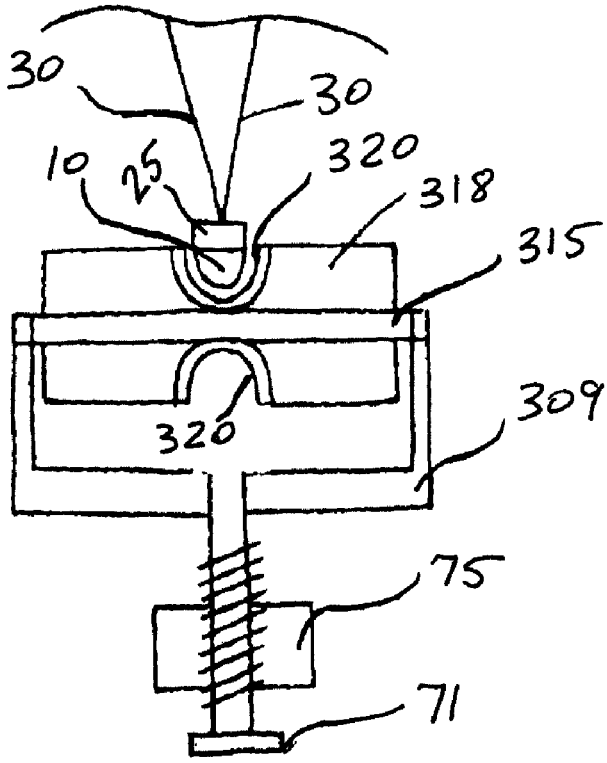
FIG. 12C is a top view of a magnetic cylinder having a contoured section for surrounding magnetic elements on the back tire of the bicycle.

The trainer disclosed at FIGS. 12A-12C also encompasses a magnet attached to the trainer bar 75 in the form of a magnetic roller 318 on a spindle 315. In FIG. 12A, the magnetic roller 318 is proximate yet not touching the magnetic sleeve 10 on the back tire 17 of the bicycle 40. The proximity of the magnetic roller 318 to the back tire 17 and sleeve 10 is adjustable via the adjustment screw 71 attached to the spindle 315 by a handle 309. FIG. 12B illustrates that the magnetic roller 318 and the magnetic sleeve 10 do not touch but are in sufficiently close proximity to vary the magnetic resistance to back tire revolution. In a preferred embodiment, shown in FIG. 12C, the magnetic roller 318 defines a contoured section 320 in which the back tire 17 fits for additional control over the magnetic field interaction. To control the resistance between the magnetic roller 318 and the back tire 17, the spindle 315 may include an oil reservoir with baffles therein to add resistance to back tire revolution. Also, the spindle 315 may extend outwardly to a separate housing for resistance fluid and baffle arrangements. These features are disclosed in more detail in the co-pending U.S. patent application Ser. No. 12/206,696 filed on Sep. 9, 2008 by Hamilton, which is incorporated by reference herein.

Each of the embodiments above can be described as utilizing a first magnetic mechanism proximate the rear of the trainer (e.g., magnetic units 60 and 103, magnetic arch 70, U-Bar magnet 121, magnetic plates 210 and 308, and magnetic roller 318) in conjunction with a second magnetic mechanism on the back tire of the bicycle (e.g., magnetic elements 12 on sleeve 10, resistance strip 38 on slotted tire 22, magnetic clip 110, rim clip 113, and magnetic spoke element 115). Accordingly, the broader terms first magnetic mechanism and second magnetic mechanism are set forth in the claims. In other embodiments, one of the magnetic mechanisms is a magnet (either permanent magnet or electromagnet) and the other is a ferromagnetic metal or metal alloy.

As noted above, each embodiment of this invention is suitable for use with an electronic control system that coordinates the training experience by adjusting the rear tire resistance and the front tire height. The front tire height, of course, is controlled by lifting mechanism (43).

It is entirely within the scope of the invention for all embodiments of the trainer to accommodate electronic control circuitry for controlling pumps, hydraulics, mechanical moving parts, and the front end lift. The electronic controls may be used in conjunction with known electronic players such as CD-Roms and other media that allow a user to simulate a real world geographical bicycle course via the trainer described herein. Although the control system is not shown in all of the drawings, every embodiment is intended to be used with a computerized system of controlling the front lift (15) and the amount of resistance to pedaling provided at the resistance cylinder (30).

Those having skill in the art will recognize that the invention may be embodied in many different types of trainers that use multiple combinations of the features noted above. Accordingly, the invention is not limited to the particular structures or software illustrated herein. In the drawings and specification there has been set forth a preferred embodiment of the invention, and although specific terms have been employed, they are used in a generic and descriptive sense only and not for purposes of limitation, the scope of the invention being defined in the claims.

The invention claimed is:

1. A bicycle and bicycle trainer combination, the combination comprising:

a bicycle trainer comprising a frame adapted to rest on a support surface while also engaging and lifting a rear tire of a bicycle off the support surface, and a first magnetic mechanism adjustably positioned on an end of the frame to provide variable resistance to rotation of the rear tire of the bicycle; and a bicycle comprising a frame, a seat, a handlebar, a drive mechanism having pedals, front and rear wheels each having a tire and a second magnetic mechanism removably attached directly onto the rear tire of the bicycle such that, when the bicycle is engaged to the bicycle trainer by having the bicycle's rear wheel and tire lifted up and supported by the bicycle trainer's frame, said first and second magnetic mechanisms are in proximity to each other to provide resistance to rotation of the rear tire.

2. A bicycle and bicycle trainer combination, according to claim 1, wherein said magnetic mechanisms have opposite polarity.

3. A bicycle and bicycle trainer combination, according to claim 1, wherein said magnetic mechanisms have the same polarity.

4. A bicycle and bicycle trainer combination, according to claim 1, wherein one of said magnetic mechanisms comprises a ferromagnetic metal.

5. A bicycle and bicycle trainer combination, according to claim 1, wherein one of said magnetic mechanisms comprises a permanent magnet.

6. A bicycle and bicycle trainer combination according to claim 1, wherein said first magnetic mechanism comprises a magnetic arch surrounding at least a portion of the rear tire of the bicycle.

7. A bicycle and bicycle trainer combination, the combination comprising:

a bicycle trainer comprising a frame adapted to rest on a support surface while also engaging and lifting a rear tire of a bicycle off the support surface, and a first magnetic mechanism adjustably positioned on an end of the frame to provide variable resistance to rotation of the rear tire of the bicycle; and a bicycle comprising a frame, a seat, a handlebar, a drive mechanism having pedals, front and rear wheels each having a tire and a second magnetic mechanism removably attached directly onto the rear tire of the bicycle such that, when the bicycle is engaged to the bicycle trainer by having the bicycle's rear wheel and tire lifted up and supported by the bicycle trainer's frame, said first and second magnetic mechanisms are in proximity to each other to provide resistance to rotation of the rear tire wherein said second magnetic mechanism comprises a removable sleeve for tucking into a rim of the rear tire of the bicycle, wherein said sleeve substantially covers the outer surface of the rear tire.

8. A bicycle and bicycle trainer combination according to claim 7, wherein said magnetic mechanisms have opposite polarity.

9. A bicycle and bicycle trainer combination according to claim 7, wherein said magnetic mechanisms have the same polarity.

10. A bicycle and bicycle trainer combination according to claim 7, wherein one of said magnetic mechanisms comprises a ferromagnetic metal.

11. A bicycle and bicycle trainer combination according to claim 7, wherein one of said magnetic mechanisms comprises a permanent magnet.

12. A bicycle and bicycle trainer combination according to claim 7, wherein one of said first magnetic mechanism comprises a magnetic arch surrounding at least a portion of the rear tire of the bicycle.

13. A bicycle and bicycle trainer combination according to claim 7, wherein said sleeve comprises at least one magnet attached to said sleeve.

14. A bicycle and bicycle trainer combination, the combination comprising:

a bicycle trainer comprising a frame adapted to rest on a support surface while also engaging and lifting a rear tire of a bicycle off the support surface, and a first magnetic mechanism adjustably positioned on an end of the frame to provide variable resistance to rotation of the rear tire of the bicycle; and a bicycle comprising a frame, a seat, a handlebar, a drive mechanism having pedals, front and rear wheels each having a tire and a second magnetic mechanism removably attached directly onto the rear tire of the bicycle such that, when the bicycle is engaged to the bicycle trainer by having the bicycle's rear wheel and tire lifted up and supported by the bicycle trainer's frame, said first and second magnetic mechanisms are in proximity to each other to provide resistance to rotation of the rear tire;

wherein one of said magnetic mechanisms comprises an electromagnet.

15. A bicycle and bicycle trainer combination according to claim 14, wherein said second magnetic mechanism comprises a magnetic strip adapted to be removably attached to the rear tire of the bicycle.

16. A bicycle and bicycle trainer combination according to claim 1, wherein said second magnetic mechanism comprises a magnetic strip adapted to be removably attached to the rear tire of the bicycle.

* * * * *